United States Patent [19]

Kumashiro et al.

[11] Patent Number: 5,002,865

[45] **Date of Patent: * Mar. 26, 1991**

[54] SILVER HALIDE PHOTOGRAPHIC MATERIAL

[75] Inventors: Kenji Kumashiro, Hachioji; Hiroshi Kashiwagi, Hino; Syoji Matsuzaka, Hachioji; Toshifumi Iijima, Kokubunji, all of Japan

[73] Assignee: Konica Corporation, Tokyo, Japan

[ * ] Notice: The portion of the term of this patent subsequent to Jul. 19, 2005 has been disclaimed.

[21] Appl. No.: 489,747

[22] Filed: Feb. 26, 1990

Related U.S. Application Data

[63] Continuation of Ser. No. 93,140, Sep. 3, 1987, abandoned, which is a continuation of Ser. No. 854,293, Apr. 21, 1986, abandoned.

[30] Foreign Application Priority Data

Apr. 24, 1985 [JP] Japan ..... 57-88392

[51] Int. Cl.[5] ..... G03C 7/38; G03C 1/035

[52] U.S. Cl. ..... 430/558; 430/549; 430/567; 430/600; 430/615

[58] Field of Search ..... 430/549, 558, 567, 600, 430/615

[56] References Cited

U.S. PATENT DOCUMENTS

| | | | |
|---|---|---|---|
| 3,817,756 | 5/1972 | Claes et al. | 96/94 |
| 4,078,937 | 3/1978 | Tani et al. | 96/107 |
| 4,400,463 | 8/1983 | Maskasky | 430/615 X |
| 4,444,865 | 4/1984 | Silverman et al. | 430/217 |
| 4,444,874 | 4/1984 | Silverman et al. | 430/409 |
| 4,542,094 | 9/1985 | Koshizuka et al. | 430/569 |
| 4,552,838 | 11/1985 | Wey et al. | 430/569 |
| 4,582,786 | 4/1986 | Ikeda et al. | 430/615 X |
| 4,600,688 | 7/1986 | Kawakatsu et al. | 430/558 |
| 4,604,339 | 8/1986 | Sugimoto et al. | 430/244 |
| 4,607,005 | 8/1986 | Urata | 430/550 |
| 4,610,958 | 9/1986 | Matsuzaka et al. | 430/567 |
| 4,643,966 | 2/1987 | Maskasky et al. | 430/567 |
| 4,680,256 | 7/1987 | Maskasky et al. | 430/567 |
| 4,683,192 | 7/1987 | Nishiyama | 430/567 |
| 4,705,743 | 11/1987 | Mihayashi et al. | 430/558 |
| 4,729,944 | 3/1988 | Mihayashi et al. | 430/376 |
| 4,758,504 | 7/1988 | Ohya et al. | 430/567 |
| 4,775,615 | 10/1988 | Matsuzaka et al. | 430/567 |

FOREIGN PATENT DOCUMENTS

| | | |
|---|---|---|
| 1810464 | 7/1969 | Fed. Rep. of Germany . |
| 2137880 | 12/1972 | France . |
| 193609 | 9/1984 | Japan . |

OTHER PUBLICATIONS

Research Disclosure No. 245, pp. 442–454, No. 24531, Havant, Hampshire, Great Britain; "Image Forming Process", Sep. 1984.

*Primary Examiner*—Paul R. Michl
*Assistant Examiner*—Lee C. Wright
*Attorney, Agent, or Firm*—Jordan B. Bierman

[57] ABSTRACT

A silver halide photographic material is disclosed, said material having silver halide emulsion layers on a support, the emulsion in said silver halide emulsion layers containing magenta coupler represented by the following formula (I), said emulsion containing silver halide grains which have a (110) plane and/or a crystal plane having an edge running through substantially the center of a (110) plane, the silver halide composition of said grains being substantially made of silver bromide and/or silver iodobromide:

(I)

where Z represents a group of the non-metallic atoms necessary for forming a nitrogen-containing hetero ring which may have a substituent; X is a hydrogen atom or a substituent which is capable of being eliminated upon reaction with the oxidation product of a color developing agent; and R is a hydrogen atom or a substituent.

10 Claims, 8 Drawing Sheets

(110)+(110)+(111)

(110)+(111)+(100)

(110)+(111)+(100)

SILVER HALIDE PHOTOGRAPHIC MATERIAL

This application is a Continuation of application Ser. No. 093,140, filed Sept. 3, 1987 now abandoned, which is a Continuation of application Ser. No. 854,293, filed Apr. 21, 1986, now abandoned.

FIELD OF THE INVENTION

The present invention relates to a silver halide photographic material and, more particularly, to one that has high stability and is free from any increase in graininess and which hence is capable of producing an image of high quality.

BACKGROUND OF THE INVENTION

Couplers based on 5-pyrazolone compounds are extensively used for forming magenta dye images in silver halide color photographic materials. The 5-pyrazolone couplers however have an unwanted absorption in the yellow at about 430 nm and such secondary absorption sometimes causes color contamination. With a view to solving this contamination problem, 1H-pyrazolo[3,2-C]-S-triazole type couplers (i.e., couplers made of 1H-pyrazolo[3,2-C]-S-triazole derivatives) have been proposed in U.S. Pat. No. 3,725,067, British Patent Nos. 1,252,418 and 1,334,515, and Unexamined Published Japanese Patent Application Nos. 99437/1984 and 228252/1984. Couplers of this type are substantially free from the unwanted secondary absorption and, hence, are capable of eliminating the color contamination problem. Some couplers, if placed together with formalin (which is used in household furniture for pest control purposes), will experience decreases in density, but the 1H-pyrazolo[3,2-C]-S-triazole type couplers undergo minimum decreases in density in the formalin atmosphere. In addition to this advantage in terms of storage stability, these couplers have high sensitivity.

In spite of these advantages, however, the 1H-pyrazolo-(3,2-C)-S-triazole type couplers may sometimes experience undesirable variations in photographic characteristics such as increased fog density and varied sensitivity if the conditions of developing solutions are disturbed by, for example, variations in pH, agitation, or changes in the pH of the developing agent. It has also been found that these disturbances sometimes cause adverse effects on the image quality by increasing the graininess of the image.

With a view to solving these problems, the present inventors proposed a new technique in Japanese Patent Application No. 193609/1984 but the results were not completely satisfactory.

SUMMARY OF THE INVENTION

The principal object, therefore, of the present invention is to provide a silver halide photographic material which is stabilized against variations in the conditions of development and is capable of producing a high-quality image with a minimum increase in graininess and which yet retains the inherent advantages of a 1H-pyrazolo(3,2-C)-S-triazole type coupler (i.e., absence of color contamination and high stability to noxious gases such as those emitted from formalin).

The present inventors found that the aforementioned object could be attained by employing specified silver halide grains in the 1H-pyrazolo(3,2-C)-S-triazole type coupler. The present invention has been accomplished on the basis of this finding.

The silver halide photographic material of the present invention has one or more silver halide emulsion layers on a support, and the emulsion in at least one of said silver halide emulsion layers contains at least one magenta coupler represented by the following formula (I), said emulsion containing silver halide grains which have a (110) plane and/or a crystal plane having an edge running through substantially the center of a (110) plane, the silver halide composition of said grains being substantially made of silver bromide and/or silver iodobromide:

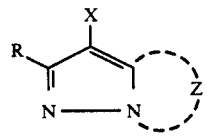

(I)

where Z represents a group of the non-metallic atoms necessary for forming a nitrogen-containing hetero ring which may have a substituent; X is a hydrogen atom or a substituent which is capable of being eliminated upon reaction with the oxidation product of a color developing agent; and R is a hydrogen atom or a substituent.

DETAILED DESCRIPTION OF THE INVENTION

The silver halide grains incorporated in emulsion in the silver halide photographic material of the present invention may be grains having a (110) plane in terms of the Miller indices, or a crystal plane having an edge running through substantially the center of a (110) plane (said crystal plane is hereunder referred to as a semi (110) plane), or both said semi (110) plane and a (110) plane. The grains may be normal crystals or twins (including multi-twins) so long as they have such planes on their outer surfaces. Morphologically, the grains may belong to one of the following groups (1) to (4), provided that they satisfy at least one of the requirements (1) and (2).

(1) The surface areas of a (110) plane and/or a semi (110) plane account for at least 30% of the total surface area of the grain. If the boundary between two adjacent crystal planes is indistinct (such as in the case of a curved border), the proportion of the surface areas of a (110) plane and/or a semi (110) plane shall be determined on the assumption that the boundary is on the line where the two planes intersect each other.

(2) The crystal shapes illustrated in accompanying FIGS. 1 to 10 and FIGS. 14 to 17.

(3) The crystal shapes shown in the electron micrographs of FIGS. 18 to 26.

(4) The emulsion coated in an oriented manner on a substrate provides the following relative intensities of diffraction lines upon powder X-ray diffraction (see Bulletin of the Society of Scientific Photography of Japan, 13, 5):

(220) plane/(111) plane ≧ 8%

(220) plane/(200) plane ≧ 5% with the following ranges being preferable:

(220) plane/(111) plane ≧ 50%

(220) plane/(200) plane ≧ 50%.

Figure 1:
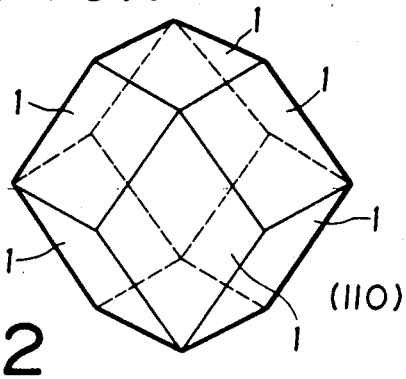
FIGS. 1 to 17 show diagrammatically the crystallographic structure of the silver halide grain used in the photographic light-sensitive material of the present invention.
Figure 2:
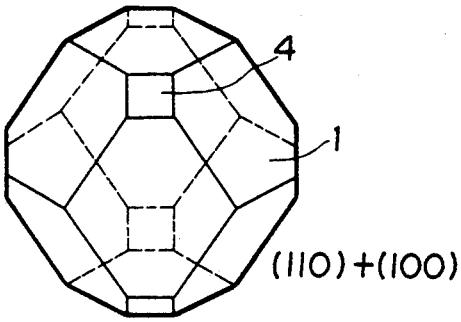
Figure 3:
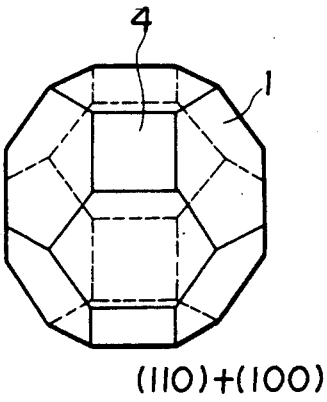
Figure 4:
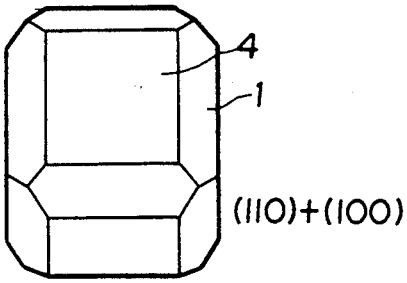
Figure 5:
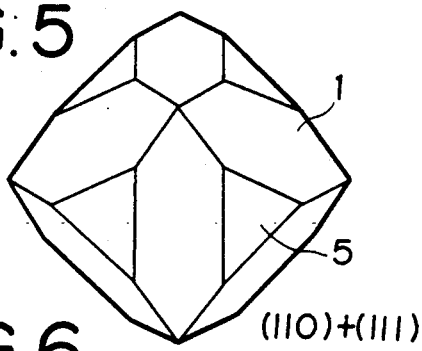
Figure 6:
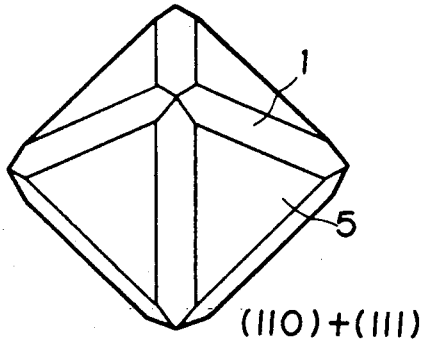
Figure 7:
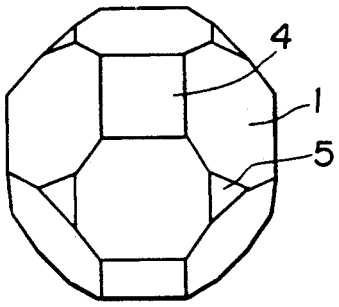
Figure 8:
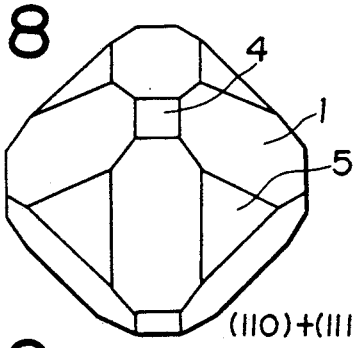
Figure 9:
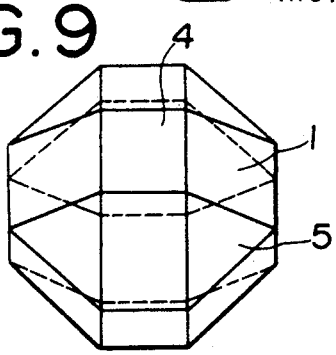
Figure 10:
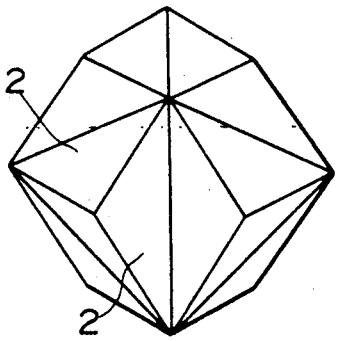

The semi (110) plane as defined in the present invention is hereunder described with reference to the accompanying drawings FIG. 10 shows the general shape of a typical silver halide grain having semi (110) planes which are indicated at 2.

Figure 11:
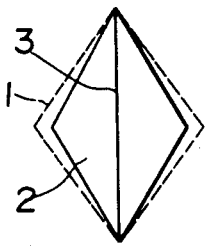
Figure 13:
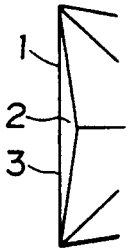
Figure 12:
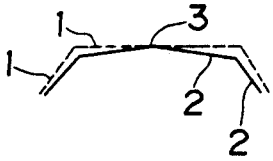
Figure 14:
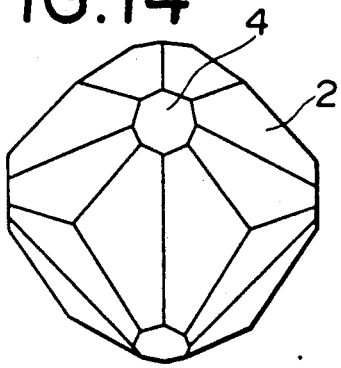
Figure 15:
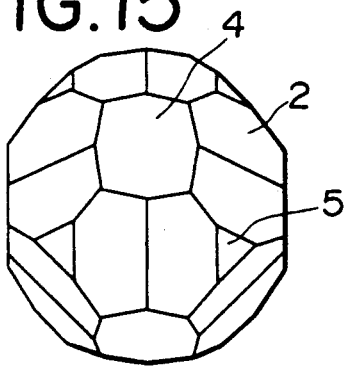
Figure 16:
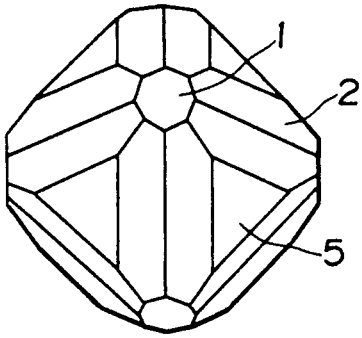
Figure 17:
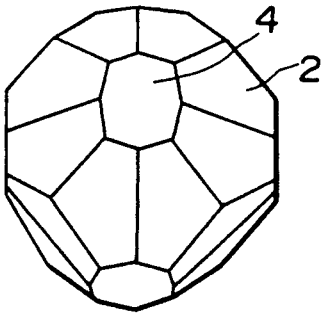
Figure 18:
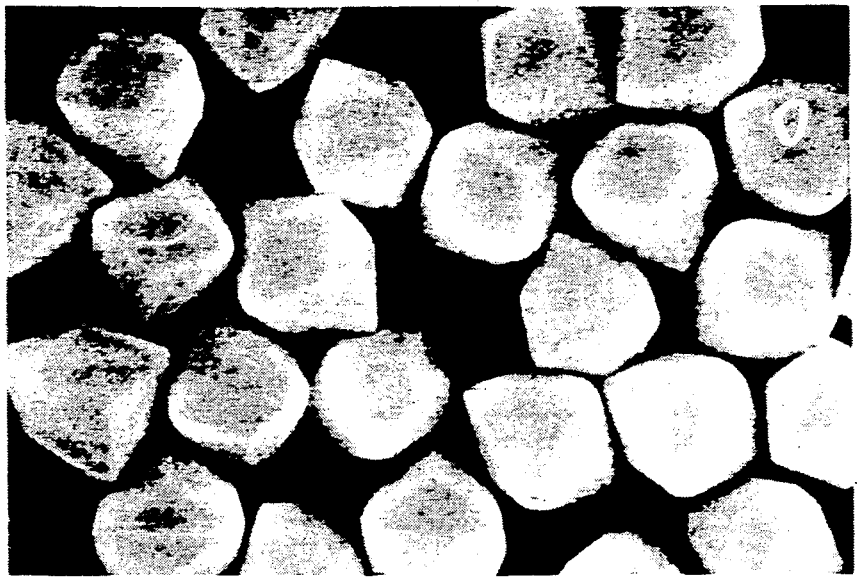
FIGS. 18 to 26 are electron micrographs of the silver halide grains used in the photographic light-sensitive material of the present invention.
Figure 19:
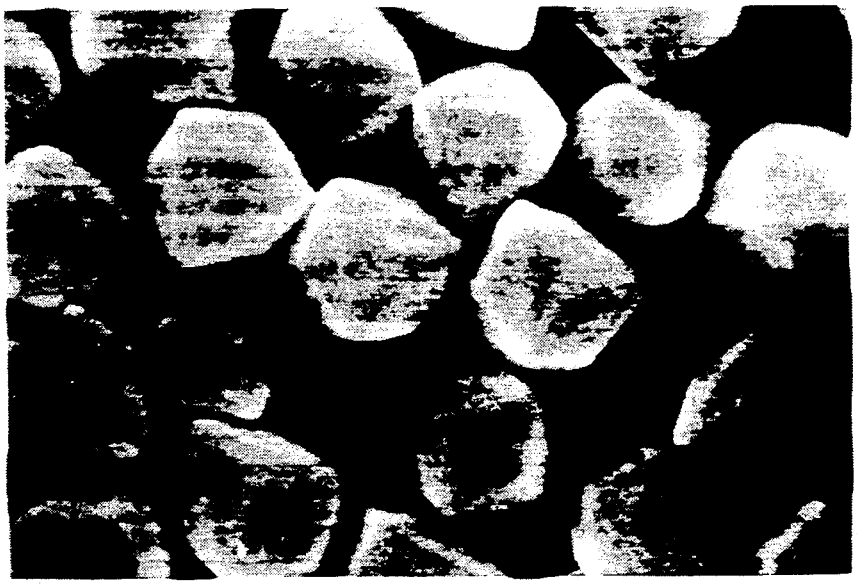
Figure 20:
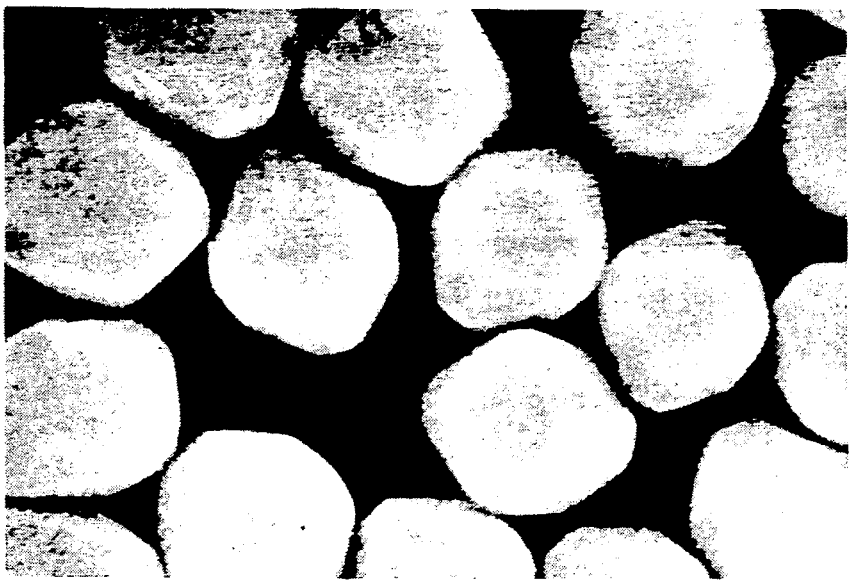
Figure 21:
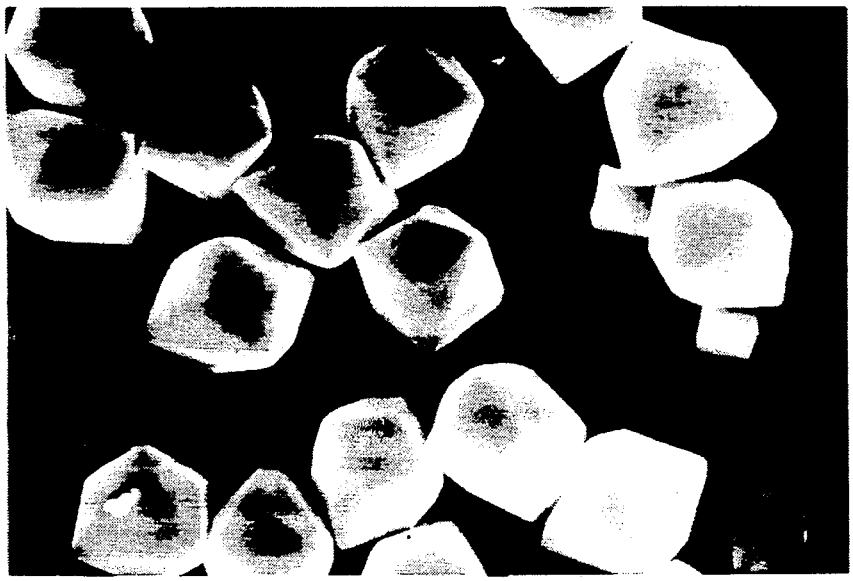
Figure 22:
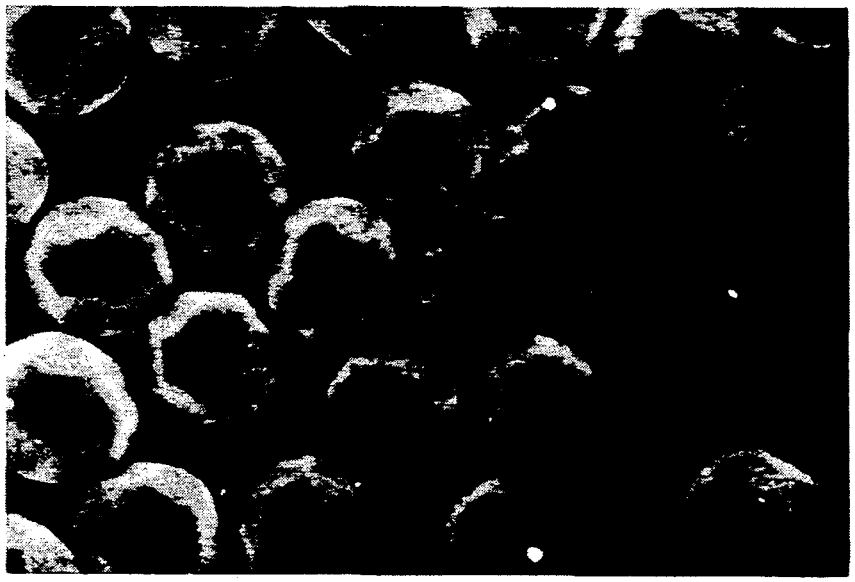
Figure 23:
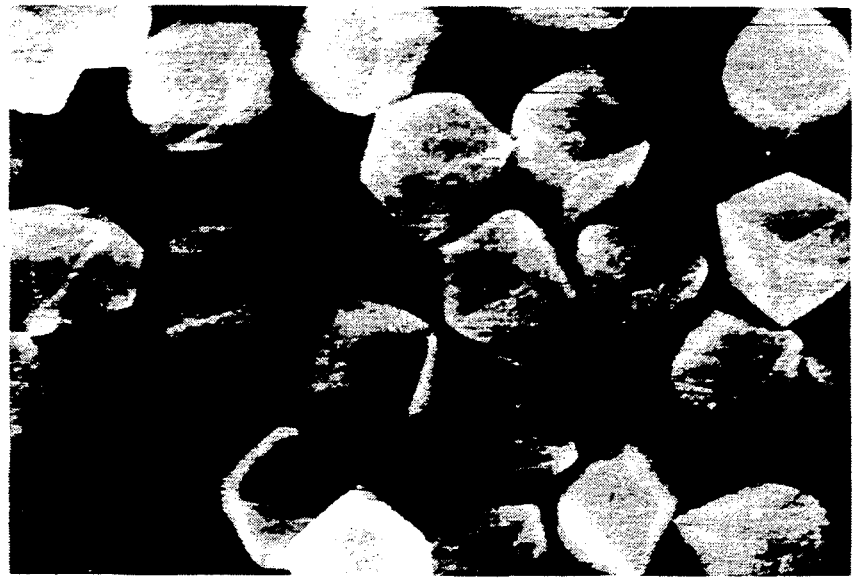
Figure 24:
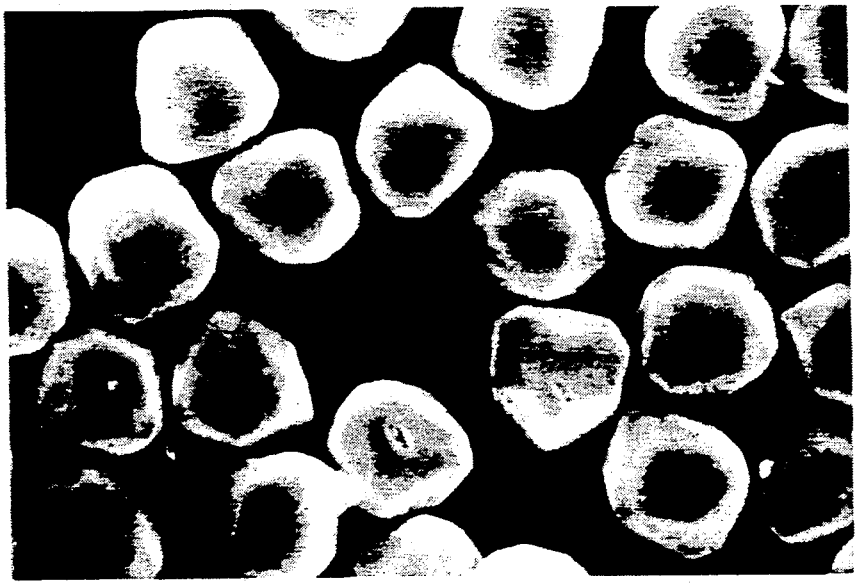
Figure 25:
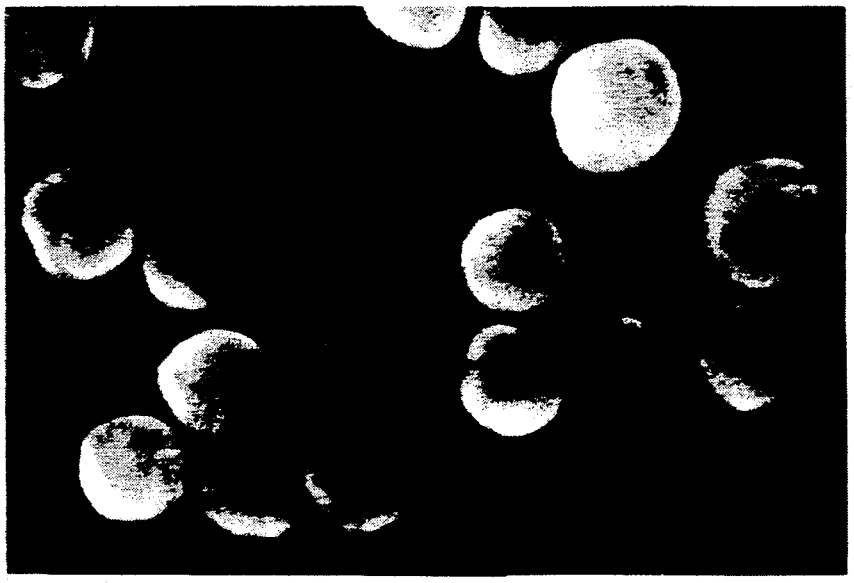
Figure 26:
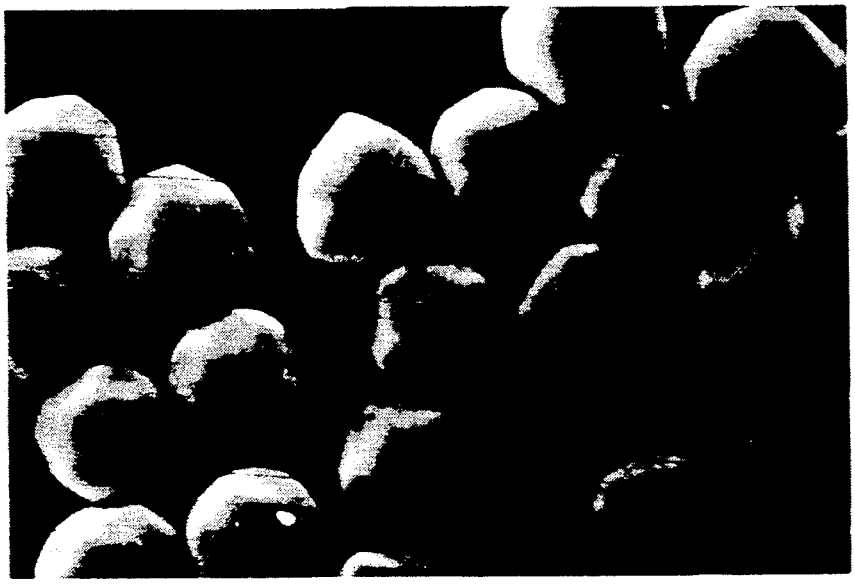

FIG. 11 is a partial plan view including a (110) plane 1 (the rhombic face defined by the dashed line) as seen in the direction perpendicular to that plane. FIGS. 12 and 13 are front and side views, respectively, of FIG. 11. In FIGS. 12 and 13, the numeral 3 denotes the central edge on the (110) plane 1, and 2 represents a semi (110) plane.

The direction in which the edge runs through the center of a (110) plane is not limited to the embodiments shown in FIGS. 10 to 13, and the two semi (110) planes having the common edge form a roof at an angle exceeding 110 degrees, as illustrated in FIGS. 14 to 17.

In accordance with the present invention, the silver halide grains in an emulsion in the light-sensitive material are substantially composed of silver bromide or silver iodobromide, and the term "substantially" allows for the possibility that the grains may contain silver chloride or other silver halide compositions not included within the category of silver bromide and/or silver iodobromide to the extent that they will not be detrimental to the objects of the present invention. It should however be noted that the total proportion of silver halides other than silver iodide is desirably not more than 10 mol%.

The proportion of silver iodide in the silver halide grains preferably ranges from 0 to 20 mol%, more preferably from 0 to 15 mol%.

For incorporation in a photographic light-sensitive material, the silver halide grains in accordance with the present invention preferably assume a core/shell structure, with the silver halide composition being substantially made of silver iodobromide.

In one preferable example, the silver halide grains are each composed of a core having a silver halide composition containing 3–40 mol% of silver iodide, and a shell over said core which has a silver halide composition containing 0–10 mol% of silver iodide, with the silver iodide content of the shell being smaller than that of the core by a degree of 2–30%. The silver iodide content of the core may change to that of the shell in any fashion, e.g., continuously or abruptly. Part of the core (e.g., the part corresponding to the seed employed in grain preparation) may be free of any silver iodide. The shell is preferably thin so as not to mask the desirable properties of the core but should be thick enough to hide its undesirable properties. More specifically, the silver halide grains preferably have a shell thickness within the range of 0.01 to 0.3 μm.

The size of the silver halide grains is not limited to any particular value but, preferably, it is within the range of 0.1 to 3.0 μm, which is sufficient for attaining the objects of the present invention in an effective manner. For the purposes of discussion hereinafter, the size of a silver halide grain is defined by the length of one side of an equivalent cube which has the same volume as the grain.

The silver halide grains in accordance with the present invention are prepared and used in the form of an emulsion where they are dispersed in a dispersion medium, typically gelatin. The particle size distribution of the grains in a group may be mono- or polydispersed, or a mixture thereof. A proper mode of size distribution may be selected depending upon the use and other factors, but substantially monodispersed grains are preferable.

In a preferred embodiment, at least 70% of all the silver halide grains in a silver halide emulsion layer in the light-sensitive material of the present invention is made up of the core/shell type grains described above. It is particularly preferable that all of the silver halide grains in an emulsion layer have a core/shell structure.

The core/shell type silver halide grains in accordance with the present invention may be used independently or, more preferably, with two or more silver halide grains having different average sizes being mixed in appropriate proportions. It is also preferable that two or more core/shell type silver halide grains having different silver iodide contents are used in combination.

In preparing the silver halide grains of the present invention, it is preferable that the pAg of the emulsion is controlled to lie between 8.0 and 9.5 for a certain period of the step where a solution of a water-soluble silver salt is mixed with a solution of a water-soluble halide in the presence of a protective colloid, thereby producing the silver halide grains. Better results are obtained if at least one compound selected from the group consisting of compounds represented by the following formulas (IT), (IIT), (IIIT) and (IVT), and a compound having a recurring unit represented by the following formula (VT) is incorporated in the emulsion:

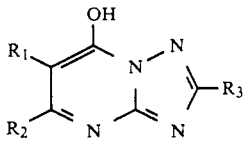

(IT)

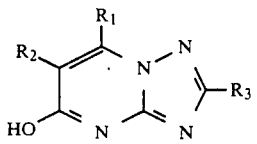

(IIT)

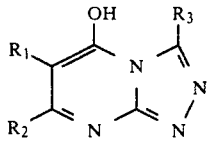

(IIIT)

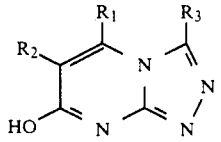

(IVT)

-continued

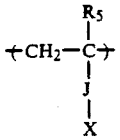

(VT)

In formulas (IT) to (IVT), $R_1$, $R_2$ and $R_3$ which may be the same or different each represents a hydrogen atom, a halogen atom, an amino group, an amino group derivative, an alkyl group, an alkyl group derivative, an aryl group, an aryl group derivative, a cycloalkyl group, a cycloalkyl group derivative, a mercapto group derivative, or —CONH—$R_4$ (where $R_4$ is a hydrogen atom, an alkyl group, an amino group, an alkyl group derivative, an amino group derivative, a halogen atom, a cycloalkyl group, a cycloalkyl group derivative, an aryl group or an aryl group derivative). In formula (VT), $R_5$ represents a hydrogen atom or an alkyl group. In formulas (IT) to (IVT), $R_1$ and $R_2$ may be fused together to form a ring (e.g., 5- to 7-membered carbon ring or a hetero ring). In formula (VT), X represents a monovalent group obtained by eliminating one hydrogen atom from the compound of formula (IT), (IIT), (IIIT) or (IVT) (such monovalent group may be obtained by eliminating one hydrogen atom from $R_1$, $R_2$, $R_3$ or OH in the formulas (IT) to (IVT)), and J represents a divalent linkage Examples of the alkyl group represented by $R_1$–$R_4$ in formulas (IT) to (IVT) include methyl, ethyl, propyl, pentyl, hexyl, octyl, isopropyl, sec-butyl and 2-norbonyl.

Examples of the alkyl group derivative represented by $R_1$–$R_4$ include alkyl groups substituted by aromatic residual groups (the substituent may contain a divalent linkage such as —NHCO—) as illustrated by benzyl, phenetyl, benzhydryl, 1-naphthylmethyl, 3-phenylbutyl and benzoylaminoethyl; alkoxy-substituted alkyl groups such as methoxymethyl, 2-methoxyethyl, 3-ethoxypropyl and 4-methoxybutyl; alkyl groups substituted by a halogen atom, a hydroxyl group, a carboxyl group, a mercapto group, an alkoxycarbonyl group or a substituted or unsubstituted amino group, as illustrated by monochloromethyl, hydroxymethyl, hydroxyethyl, 3-hydroxybutyl, 2-carboxyethyl, 2-(methoxycarbonyl-)ethyl, aminomethyl and diethylaminomethyl; cycloalkyl-substituted alkyl groups such as cyclopentylmethyl; and alkyl groups substituted by monovalent groups obtained by eliminating one hydrogen atom from the compounds of formulas (IT) to (IVT).

Examples of the aryl group represented by $R_1$–$R_4$ include phenyl and 1-naphthyl. Illustrative aryl group derivatives include p-tolyl, m-ethylphenyl, m-cumenyl, mesityl, 2,3-xylyl, p-chlorophenyl, o-bromophenyl, p-hydroxyphenyl, 1-hydroxy-2-naphthyl, m-methoxyphenyl, p-ethoxyphenyl, p-carboxyphenyl, o-(methoxycarbonyl)phenyl, m-(ethoxycarbonyl)phenyl and 4-carboxy-1-naphtyl.

Examples of the cycloalkyl group represented by $R_1$–$R_4$ include cycloheptyl, cyclopentyl and cyclohexyl. An illustrative cycloalkyl group derivative is methylcyclohexyl. Examples of the halogen atom represented by $R_1$–$R_4$ include fluorine, chlorine, bromine and iodine. Examples of the amino group derivative represented by $R_1$–$R_4$ include butylamino, diethylamino and anilino groups. Examples of the mercapto group derivative represented by $R_1$–$R_3$ include methylthio, ethylthio and phenylthio groups.

The alkyl group represented by $R_5$ preferably has 1–6 carbon atoms, and illustrative examples are methyl and ethyl. A hydrogen atom or a methyl group is a particularly preferable example of $R_5$.

The symbol J represents a divalent linkage which preferably has a total of 1–20 carbon atoms. A particularly preferable linkage is represented by the following formula (J-I) or (J-II):

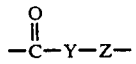

(J-I)

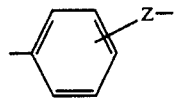

(J-II)

where Y is —O— or

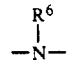

(where $R_6$ is a hydrogen atom or an alkyl group of 1–6 carbon atoms).

The symbol Z represents an alkylene group (preferably having up to 10 carbon atoms) which may be interrupted by an amido bond, ester bond or an ether bond, as illustrated by methylene, ethylene, propylene, —$CH_2OCH_2$—, —$CH_2CONHCH_2$—, —$CH_2CH_2COOCH_2$—, —$CH_2CH_2OCOCH_2$— or —$CH_2NHCOOCH_2$—), an —O—alkylene group, —CHNH—alkylene group, —COO—alkylene group, —OCO—alkylene group or an —NHCO—alkylene group (these alkylene groups preferably having up to 10 carbon atoms) or an arylene group (preferably having 6–12 carbon atoms, as illustrated by p-phenylene).

The following are particularly preferable examples of J as the divalent linkage:

—$CONHCH_2$—, —$CONHCH_2CH_2$—,

—$CONHCH_2OCOCH_2$—, —$CONHCH_2CH_2CH_2OCOCH_2$—,
—$COOCH_2$—, —$COOCH_2CH_2$—, —$COOCH_2CH_2OCOCH_2$—,

—$COOCH_2CH_2CH_2OCOCH_2$—, 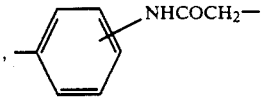

The compound having the recurring unit represented by the formula (VT) may be a homo- or copolymer, and illustrative copolymers include poly(acrylamide), poly(methacrylamide), poly(acrylic ester) and poly(methacrylic ester).

Typical examples of the compounds represented by the formula (IT), (IIT), (IIIT) or (IVT), and the compounds having the recurring unit represented by the formula (VT) are listed below (these compounds are hereinafter referred to as the tetrazaindene compounds to be used in the present invention):

(1)
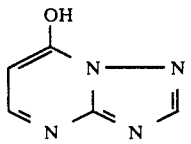
(2)
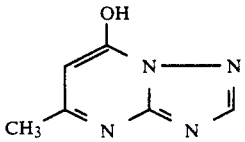
(3)
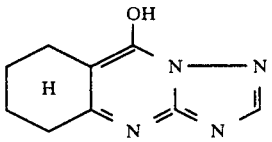
(4)
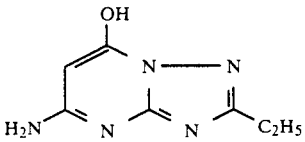
(5)
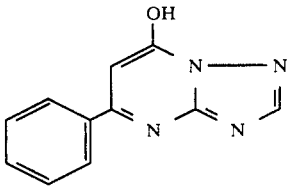
(6)
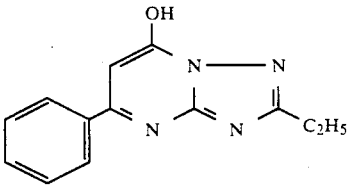
(7)
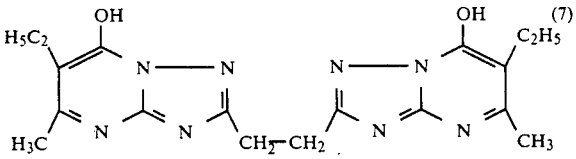
(8)
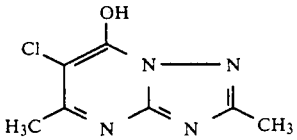
(9)
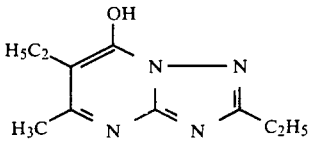
(10)
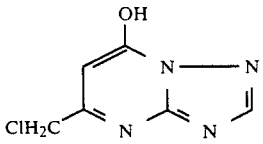
-continued
(11)
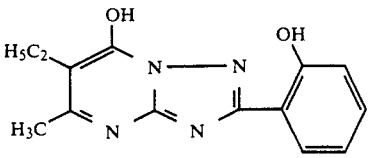
(12)
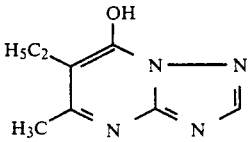
(13)
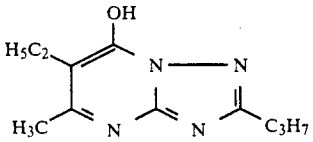
(14)
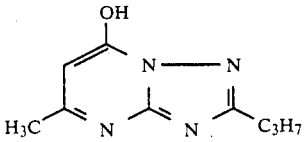
(15)
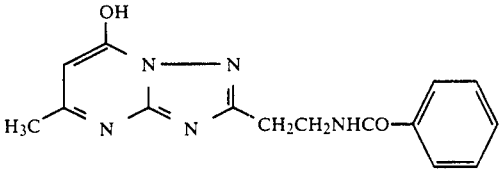
(16)
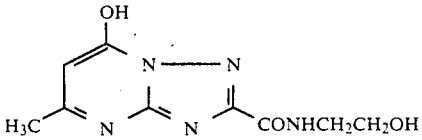
(17)
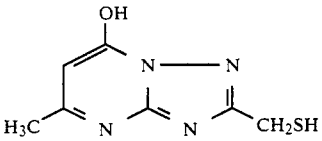
(18)
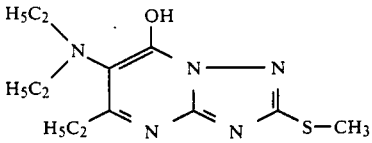
(19)
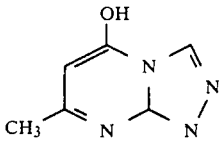
(20)
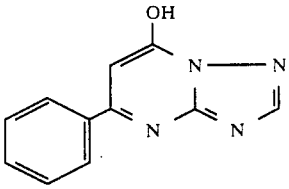

-continued (21)

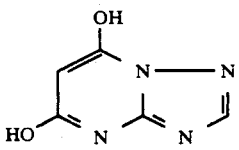

(22)

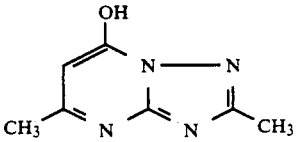

(23)

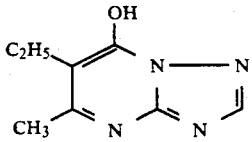

(24)

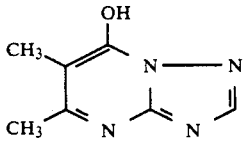

(25)

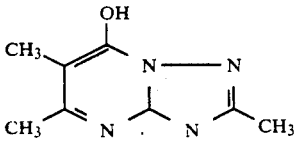

(26)

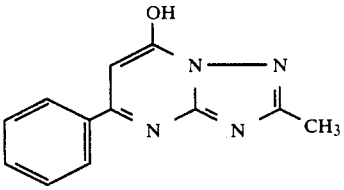

(27)

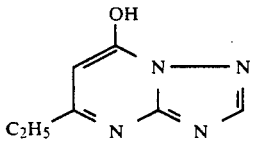

(28)

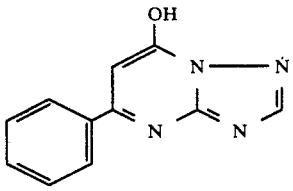

(29)

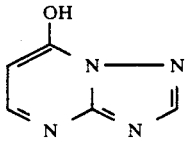

(30)

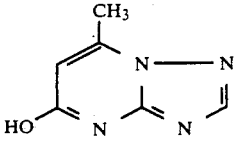

-continued (31)

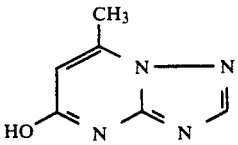

(32)

a copolymer

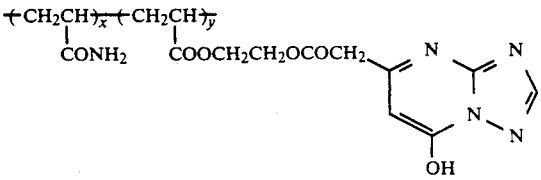

y: 5–50 mol %

(33)

a copolymer

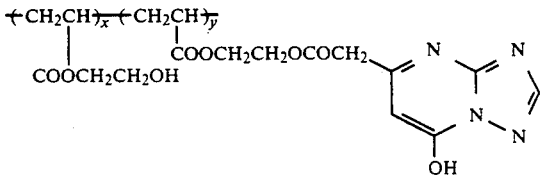

y: 5–50 mol %

(34)

a copolymer

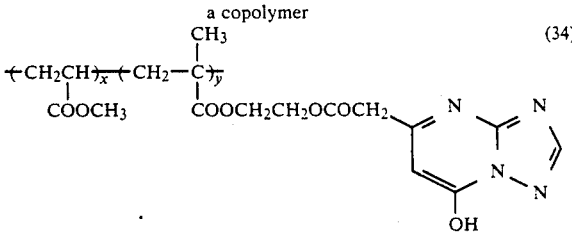

y: 5–50 mol %

(35)

a copolymer

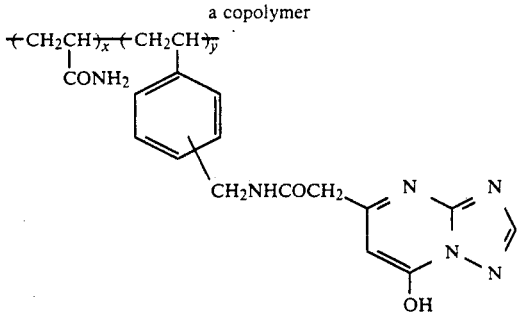

y: 5–50 mol %

(36)

a copolymer

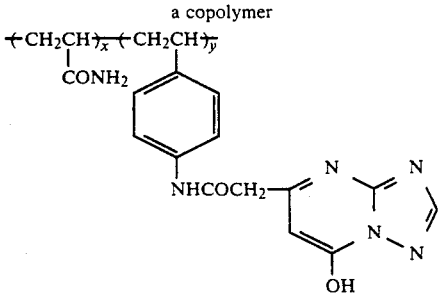

y: 5–50 mol %

The amount of the tetrazaindene compounds to be used in the present invention varies with the size of the silver halide grains to be formed and with such process conditions as the temperature, pH, pAg and silver iodide content of the emulsion; preferably, the tetrazaindene compounds are added in amounts ranging from $10^5$ to $2\times10^{-1}$ mole per mole of the total silver halide formed. When the tetrazaindene compound is a compound having the recurring unit represented by formula (VT), the amount of the compound to be added is calculated in terms of the number of moles of the tetrazaindene moiety.

The tetrazaindene compound used in the present invention may be incorporated in the emulsion by various methods such as, for example, by incorporating it in a solution of protective colloid before grain preparation, by adding it slowly in accordance with the growth of silver halide grains, or by the combination of these methods.

The silver halide grains in accordance with the present invention may be prepared by causing a silver halide to grow as a coat on seed grains. The silver halide composition of the seed may be within the range which ensures the formation of the silver halide grains in accordance with the present invention.

The pAg of the emulsion may be controlled for any length of time that is within the limits of period of silver halide formation; pAg control may be effected at the initial, intermediate or last stage of the step of silver halide formation. The pAg of the emulsion is preferably controlled for a continuous period, but intermittent control may be performed on the condition that it will not be harmful to the objects of the present invention. Throughout the period of control, the pAg of the emulsion is preferably held at a value between 8.0 and 9.5, more preferably between 8.4 and 9.2, with the pH of the emulsion being preferably held within the range of 7 and 10. During the period when no pAg control is made, the pAg of the silver halide emulsion is advantageously held between 4 and 11.5, preferably between 6 and 11, with the pH being held advantageously between 2 and 12, preferably between 5 and 11.

The silver halide grains in accordance with the present invention are preferably formed by the double-jet method wherein an aqueous solution of ammoniacal silver nitrate and an aqueous solution of halide are added simultaneously in the presence of ammonia It is also preferable that silver and halide solutions are added such that no new crystal nuclei will form during the growth of grains Core/shell type silver halide grains may be prepared by forming a shell coat on the so formed core of a silver halide grain. The shell may be formed by depositing a solution of soluble halide and a solution of soluble silver salt on the core in accordance with the double-jet method For further details of the method of preparing core/shell type silver halide grains, see, for example, German Patent No. 1,169,290, British Patent No. 1,027,146, Unexamined Published Japanese Patent Application No. 154232/1982 and Japanese Patent Publication No. 1417/1976.

The silver halide grains in accordance with the present invention may be subjected to reduction sensitization at any stage of their preparation. Reduction sensitization may be performed by silver ripening wherein the emulsion is agitated under low pAg conditions, or with the aid of an appropriate reducing agent such as tin chloride, dimethylaminoborane, hydrazine or thiourea dioxide.

The magenta coupler represented by formula (I) (hereinafter referred to as the magenta coupler of the present invention) is hereunder described in detail.

In the magenta coupler of formula (I), the substituent represented by R includes, for example, a halogen atom, an alkyl group, a cycloalkyl group, an alkenyl group, a cycloalkenyl group, an alkinyl group, an aryl group, a heterocyclic group, an acyl group, a sulfonyl group, a sulfinyl group, a phosphonyl group, a carbamoyl group, a sulfamoyl group, a cyano group, a spiro-compound residue, a bridged hydrocarbon compound residue, an alkoxy group, an aryloxy group, a heterocyclic oxy group, a siloxy group, an acyloxy group, a carbamoyloxy group, an amino group, an acylamino group, a sulfonamide group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclic thio group.

The halogen atom includes, for example, chlorine and bromine atoms, the chlorine atom being particularly preferable.

The alkyl group represented by R is preferably one having 1 to 32 carbon atoms, the alkenyl group and the alkinyl group are preferably those having 2 to 32 carbon atoms, and the cycloalkyl group and the cycloalkenyl group are preferably those having 3 to 12, particularly 5 to 7, carbon atoms, the alkyl, alkenyl and alkinyl groups each including those having a straight or branched chain.

These alkyl, alkenyl, alkinyl, cycloalkyl and cycloalkenyl groups each may have one or more substituents. Such substituents include, in addition to an aryl group, a cyano group, a halogen atom, a heterocyclic group, a cycloalkyl group, a cycloalkenyl group, a spiro-compound residue and a bridged hydrocarbon compound residue, those substituted through the carbonyl group, such as acyl, carboxy, carbamoyl, alkoxycarbonyl and aryloxycarbonyl groups, and those substituted through the hetero atom, for example, those substituted through the oxygen atom, such as hydroxy, alkoxy, aryloxy, heterocyclic oxy, siloxy, acyloxy and carbamoyloxy groups, those substituted through the nitrogen atom, such as nitro, amino (including dialkylamino and the like), sulfamoylamino, alkoxycarbonylamino, aryloxycarbonylamino, acylamino, sulfoneamido, imido and ureido groups, those substituted through the sulfur atom, such as alkylthio, arylthio, heterocyclic thio, sulfonyl, sulfinyl and sulfamoyl groups, and those substituted through the phosphorus atom, such as a phosphonyl group and the like.

Examples of the alkyl group represented by R include, for example, methyl, ethyl, isopropyl, t-butyl, pentadecyl heptadecyl, 1-hexylnonyl, 1,1'-dipentylnonyl, 2-chloro-t-butyl, trifluoromethyl, 1-ethoxytridecyl, 1-methoxyisopropyl, methanesulfonylethyl, 2,4-di-t-amylphenoxymethyl, anilino, 1-phenylisopropyl, 3-m-butanesulfonaminophenoxypropyl, 3-4'-{α-[4''(p-hydroxybenzenesulfonyl)phenoxy]dodecanoylamino}phenylpropyl, 3-{4'-[α-(2'',4''-di-t-amylphenoxy)-butaneamido]phenyl}propyl, 4-[α-(o-chlorophenoxy)-tetradecanamidophenoxy]propyl, allyl, cyclopentyl and cyclohexyl groups.

The aryl group represented by R is preferably a phenyl group, and may have a substituent such as an alkyl, alkoxy or acylamino group.

Examples of the aryl group include phenyl, 4-t-butylphenyl, 2,4-di-t-amylphenyl, 4-tetradecaneamidophenyl hexadecyloxyphenyl and 4'-[α-(4''-t-butylphenoxy)tetradecaneamido]phenyl groups.

The heterocyclic group represented by R is preferably a 5- to 7-membered heterocyclic ring, and may be substituted or may be condensed. Examples of the heterocyclic group include 2-furyl, 2-thienyl, 2-pyrimidinyl and 2-benzothiazolyl groups.

The acyl group represented by R includes, for example, an alkylcarbonyl group such as acetyl, phenylacetyl dodecanoyl and α-2,4-di-t-amylphenoxybutanoyl groups, and an arylcarbonyl group such as benzoyl, 3-pentadecyloxybenzoyl and p-chlorobenzoyl groups.

The sulfonyl group represented by R includes, for example, an alkylsulfonyl group such as methylsulfonyl and dodecylsulfonyl groups, and an arylsulfonyl group such as benzenesulfonyl and p-toluenesulfonyl groups.

The sulfinyl group represented by R includes, for example, an alkylsulfinyl group such as ethylsulfinyl, octylsulfinyl and 3-phenoxybutylsulfinyl groups and an arylsulfinyl group such as phenylsulfinyl and m-pentadecylphenylsulfinyl groups.

The phosphonyl group represented by R includes, for example, an alkylphosphonyl group such as butyl octyl phosphonyl group, an alkoxyphosphonl group such as octyloxyphosphonyl group, an aryloxyphosphonyl group such as phenoxyphosphonyl group and an arylphosphonyl group such as phenylphosphonyl group.

The carbamoyl group represented by R includes, for example, those substituted with an alkyl or aryl (preferably phenyl) group, such as, N-methylcarbamoyl, N,N-dibutylcarbamoyl, N-(2-pentadecyloctylethyl)carbamoyl, N-ethyl-N-dodecylcarbamoyl and N-{3-(2,4-di-t-amylphenoxy)propyl}carbamoyl group.

The sulfamoyl group represented by R includes, for example, those substituted with an alkyl or aryl (preferably phenyl) group, such as N-propylsulfamoyl, N,N-diethylsulfamoyl, N-(2-pentadecyloxyethyl)sulfamoyl, N-ethyl-N-dodecylsulfamoyl and N-phenylsulfamoyl groups.

The spiro-compound residue represented by R includes, for example, spiro[3,3]heptan-1-yl and the like.

The bridged hydrocarbon compound residue represented by R includes, for example, bicyclo[2,2,1]heptan-1-yl, tricyclo-[3,3,1,1,3,7]decan-1-yl and 7,7-dimethylbichclo-[2,2,1]heptan-1-yl.

The alkoxy group represented by R includes, for example, those substituted further with such a substituent(s) as is shown above with the alkyl group, such as methoxy, propoxy, 2-methoxyethoxy, pentadecyloxy, 2-dodecyloxyethoxy and phenethyloxyethoxy.

The aryloxy group represented by R is preferably a phenyloxy group, and includes, for example, those wherein the aryl nucleus is further substituted with such a substituent(s) or an atom(s) as is shown above with the aryl group, such as phenoxy, p-t-butylphenoxy and m-pentadecylphenoxy groups.

The heterocyclic oxy group represented by R is preferably one having a 5- to 7-membered heterocyclic ring, and includes those wherein the heterocyclic ring has a substituent, such as 3,4,5,6-tetrahydropyranyl-2-oxy and 1-phenyltetrazol-5-oxy groups.

The siloxy group represented by R includes those substituted with an alkyl group, for example, trimethylsiloxy, triethylsiloxy and dimethylbutylsiloxy groups.

The acyloxy group represented by R includes, for example, alkylcarbonyloxy and arylcarbonyloxy groups, and further includes those having a substituent(s) such as acetyloxy α-chloroacetyloxy and benzoyloxy groups.

The carbamoyloxy group represented by R includes those substituted with an alkyl or aryl group, such as N-ethylcarbamoyloxy, N,N-diethylcarbamoyloxy and N-phenylcarbamoyloxy groups.

The amino group represented by R includes those substituted with an alkyl or aryl (preferably phenyl) group, such as ethylamino, anilino, m-chloroanilino, 3-pentadecyloxycarbonylanilino and 2-chloro-5-hexadecaneamidoanilino groups.

The acylamino group represented by R includes alkylcarbonylamino and arylcarbonylamino (preferably phenylcarbonylamino) groups, and further includes those having a substituent(s) such as acetamido, α-ethylpropaneamido, N-phenylacetamido, dodecaneamido, 2,4-di-t-amylphenoxyacetamido and α-3-t-butyl-4-hydroxyphenoxybutaneamido groups.

The sulfonamido group represented by R includes alkylsulfonylamino and arylsulfonylamino groups, and further includes those having a substituent(s), such as methylsulfonylamino, pentadecylsulfonylamino, benzenesulfonamido, p-toluenesulfonamido and 2-methoxy-5-t-amylbenzenesulfonamido groups.

The imido group represented by R includes those which are open-chained or close-chained, and further includes those having a substituent(s), such as, succinimido, 3-heptadecylsuccinimido, phthalimido and glutarimido groups.

The ureido group represented by R includes those substituted with an alkyl or aryl (preferably phenyl) group, such as N-ethylureido, N-methyl-N-decylureido, N-phenylureido and N-p-tolylureido groups.

The sulfamoylamino group represented by R includes those substituted with an alkyl or aryl (preferably phenyl) group, such as N,N-dibutylsulfamoylamino, N-methylsufamoylamino and N-phenylsulfamoylamino groups.

The alkoxycarbonylamino group represented by R includes those having a substituent(s), such as methoxycarbonylamino, methoxyethoxycarbonylamino and octadecyloxycarbonylamino groups.

The aryloxycarbonylamino group represented by R includes those having a substituent(s), such as phenoxycarbonylamino and 4-methylphenoxycarbonylamino groups.

The alkoxycarbonyl group represented by R includes those having a substituent(s), such as methoxycarbonyl, butyloxycarbonyl, dodecyloxycarbonyl, octadecyloxycarbonyl, ethoxymethoxycarbonyloxy and benzyloxycarbonyl groups.

The aryloxycarbonyl group represented by R includes those having a substituent(s), such as phenoxycarbonyl, p-chlorophenoxycarbonyl and m-pentadecyloxyphenoxycarbonyl groups.

The alkylthio group represented by R includes those having a substituent(s), such as ethylthio, dodecylthio, octadodecylthio, phenethylthio and 3-phenoxypropylthio groups.

The arylthio group represented by R is preferably a phenylthio group, and includes those having a substituent(s), such as phenylthio, p-methoxyphenylthio, 2-t-octylphenylthio, 3-octadecylphenylthio, 2-carboxyphenylthio and p-acetaminophenylthio groups.

The heterocyclicthio group, represented by R is preferably a 5- to 7-membered heterocyclicthio group, and includes those having a condensed ring or having a substituent(s). Examples of such heterocyclicthio group include 2-pyridylthio, 2-benzothiazolylthio and 2,4-diphenoxy-1,3,5-triazole-6-thio groups.

The substituent represented by X that is capable of leaving upon reaction with the oxidized product of a color developing agent includes, for example, those substituted through the carbon, oxygen, sulfur or nitrogen atom other than the halogen atom (chlorine, bromine or fluorine atom).

The groups which are substituted through the carbon atom include, in addition to the carboxyl group, a group represented by the following formula:

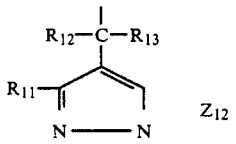

(wherein $R_{11}$ is the same in meaning as said R; $Z_2$ is the same in meaning as said $Z_1$; and $R_{12}$ and $R_{13}$ each represents a hydrogen atom, an aryl, alkyl or heterocyclic group), a hydroxymethyl group or a triphenylmethyl group.

The groups which are substituted through the oxygen atom include, for example, alkoxy, aryloxy, heterocyclicoxy, acyloxy, sulfonyloxy, alkoxycarbonyloxy, aryloxycarbonyloxy, alkyloxalyloxy and alkoxyoxalyloxy groups.

The alkoxy group includes those having a substituent(s), such as ethoxy, 2-phenoxyethoxy, 2-cyanoethoxy, phenethyloxy, and p-chlorobenzyloxy groups.

The aryloxy group is preferably a phenoxy group, and includes those having a substituent(s). Examples of such aryloxy group include phenoxy, 3-methylphenoxy, 3-dodecylphenoxy, 4-methanesulfoneamidophenoxy, 4-[α-(3'-pentadecylphenoxy)butaneamido]phenoxy, hexadecylcarbamoylmethoxy, 4-cyanophenoxy, 4-methanesulfonylphenoxy, 1-naphthyloxy and p-methoxyphenoxy group.

The heterocyclicoxy group is preferably a 5- to 7-membered heterocyclicoxy group, and may be a condensed ring or include those having a substituent(s). Examples of such heterocyclicoxy group include 1-phenyltetrazolyloxy and 2-benzothiazolyloxy groups.

The acyloxy group includes, for example, an alkylcarbonyloxy group such as acetoxy and butanoyloxy groups, an alkenylcarbonyloxy group such as a cinnamoyloxy group, and an arylcarbonyloxy group such as a benzoyloxy group.

The sulfonyloxy group includes, for example, butanesulfonyloxy and methanesulfonyloxy groups.

The alkoxycarbonyloxy group includes, for example, ethoxycarbonyloxy and benzyloxycarbonyloxy groups.

The aryloxycarbonyloxy group includes a phenoxycarbonyloxy group and the like.

The alkyloxalyloxy group includes, for example, a methyloxyalyloxy group.

The alkoxyoxalyloxy group includes an ethoxyoxalyloxy group and the like.

The group which is substituted through the sulfur atom includes, for example, alkylthio, arylthio, heterocyclictio and alkyloxythiocarbonylthio groups.

The alkylthio group includes butylthio, 2-cyanoethylthio, phenetylthio and benzylthio groups.

The arylthio group includes phenylthio, 4-methanesulfoneamidophenylthio, 4-dodecylphenylthio, 4-nonafluoropentaneamidophenylthio, 4-carboxyphenylthio and 2-ethoxy-5-t-butylphenylthio groups.

The heterocyclicthio group includes, for example, 1-phenyl-1,2,3,4-tetrazolyl-5-thio and 2-benzothiazolylthio groups.

The alkyloxythiocarbonylthio group includes a dodecyloxythiocarbonylthio group and the like.

The group which is substituted through the nitrogen atom includes, for example, one represented by the formula

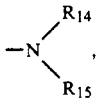

wherein $R_{14}$ and $R_{15}$ each represents a hydrogen atom, an alkyl, aryl, heterocyclic, sulfamoyl, carbamoyl, acyl, sulfonyl, aryloxycarbonyl or alkoxycarbonyl group, and $R_{14}$ and $R_{15}$ may cooperate to form a heterocyclic ring, provided that $R_{14}$ and $R_{15}$ are not hydrogen atoms at the same time.

The alkyl group may be straight-chaned or branched and is preferably one having 1 to 22 carbon atoms. Also, the alkyl group may include those having a substituent(s). Examples of such substituent include, for example, aryl, alkoxy, aryloxy, alkylthio, arylthio, alkylamino, arylamino, acylamino, sulfoneamido, imino, acyl, alkylsulfonyl, arylsulfonyl, carbamoyl, sulfamoyl, alkoxycarbonyl, aryloxycarbonyl, alkyloxycarbonylamino, aryloxycarbonylamino, carboxyl and ciano groups and halogen atom. Examples of such alkyl group includes, for example, ethyl, octyl, 2-ethylhexyl and 2-chloroethyl group.

The aryl group represented by $R_{14}$ or $R_{15}$ is preferably one having 6 to 32 carbon atoms, particularly a phenyl or naphtyl group, and may include those having a substituent(s). Such substituent includes a substituent for the alkyl group represented by $R_{14}$ or $R_{15}$ and an alkyl group. Examples of the aryl group include, for example, phenyl, 1-naphtyl and 4-methylsulfonylphenyl groups.

The heterocyclic group represented by $R_{14}$ or $R_{15}$ is preferably a 5- or 6-membered ring, and may be a condensed ring or include those having a substituent(s). Examples of such heterocyclic group include 2-furyl, 2-quinolyl, 2-pyrimidyl, 2-benzothiazolyl and 2-pyridyl groups.

The sulfamoyl group represented by $R_{14}$ or $R_{15}$ includes N-alkylsulfamoyl, N,N-dialkylsulfamoyl, N-arylsulfamoyl and N,N-diarylsulfamoyl groups, and these alkyl and aryl groups may have such a substituent(s) as is mentioned with respect to the alkyl and aryl groups. Examples of such sulfamoyl group includes, for example, N,N-diethylsulfamoyl, N-methylsulfamoyl, N-dodecylsulfamoyl and N-p-tolylsulfamoyl groups.

The carbamoyl group represented by $R_{14}$ or $R_{15}$ includes N-alkylcarbamoyl, N,N-dialkylcarbamoyl, N-arylcarbamoyl and N,N-diarylcarbamoyl groups, and these alkyl and aryl groups may have such a substituent(s) as is mentioned with respect to the alkyl and aryl groups. Examples of such carbamoyl group include, for example, N,N-diethylcarbamoyl, N-methylcarbamoyl, N-dodecylcarbamoyl, N-p-cianophenylcarbamoyl and N-p-tolylcarbamoyl groups.

The acyl group represented by $R_{14}$ or $R_{15}$ includes, for example, alkylcarbonyl, arylcarbonyl and heterocyclicarbonyl groups, and the alkyl, aryl and heterocyclic groups may have a substituent(s). Examples of such acyl group include, for example, hexafluorobutanoyl, 2,3,4,5,6-pentafluorobenzoyl, acetyl, benzoyl, naphtoyl and 2-furylcarbonyl groups.

The sulfonyl group represented by $R_{14}$ or $R_{15}$ includes alkylsulfonyl, arylsulfonyl and heterocyclicsulfonyl groups, and may have a substituent(s). Examples of such sulfonyl group include, for example, ethanesulfonyl, benzenesulfonyl, octanesulfonyl, naphthalenesulfonyl and p-chlorobenzenesulfonyl groups.

The aryloxycarbonyl group represented by $R_{14}$ or $R_{15}$ may have such a substituent(s) as is mentioned with respect to the aryl group, and includes a phenoxycarbonyl group and the like.

The alkoxycarbonyl group represented by $R_{14}$ or $R_{15}$ may have such a substituent(s) as is mentioned with respect to alkyl group, and includes methoxycarbonyl, dodecyloxycarbonyl and benzyloxycarbonyl groups.

The heterocyclic ring which is formed through cooperation of $R_{14}$ and $R_{15}$ is preferably a 5- or 6-membered ring, may be saturated or unsaturated, may or may not be an aromatic ring, or may be a condensed ring. Examples of such heterocyclic ring include, for example, N-phthalimido, N-succinimide, 4-N-urazolyl, 1-N-hydantoinyl, 3-N-2,4-dioxoxazolidinyl, 2-N-1,1-dioxo-3-(2H)-oxo-1,2-benzthiazolyl, 1-pyrrolyl, 1-pyrrolidinyl, 1-pyrazolyl, 1-pyrazolidinyl, 1-piperidinyl, 1-pyrrolinyl, 1-imidazolyl, 1-imidazolinyl, 1-indolyl, 1-isoindolinyl, 2-isoindolyl, 2-isoindolinyl, 1-benzotriazolyl, 1-benzoimidazolyl, 1-(1,2,4-triazolyl), 1-(1,2,3-triazolyl), 1-(1,2,3,4-tetrazolyl), N-morpholinyl, 1,2,3,4-tetrahydroquinolyl, 2-oxo-1-pyrrolidinyl, 2-1H-pyridone, phthalazione and 2-oxo-1-piperidinyl groups. These heterocyclic groups may be substituted by alkyl, aryl, alkyloxy, aryloxy, acyl, sulfonyl, alkylamino, arylamino, acylamino, sulfoneamino, carbamoyl, sulfamoyl, alkylthio, arylthio, ureido, alkoxycarbonyl, aryloxycarbonyl, imido, nitro, cyano, carboxyl groups as well as by a halogen atom and the like.

The nitrogen-containing heterocyclic ring which is formed by $Z_1$ or $Z_2$ includes pyrazole, imidazole, triazole and tetrazole rings, and may have such a substituent(s) as is mentioned with respect to R.

When the substituent(s) (for example, either of R'' and $R_{21}$ to $R_{28}$) on the heterocyclic ring in formula (I) and in formulas (VI) to (XII) to be mentioned later has a portion represented by the following formula (XIII):

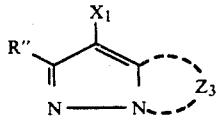

(XIII)

(wherein R'', $X_1$ and $Z_3$ are the same in meaning as R, $X_1$ and $Z_1$ in formula (I), respectively), the coupler formed is the so-called bis-type coupler, which is included in the present invention. The ring which is formed by $Z_1$, $Z_2$, $Z_3$ as well as by $Z_4$ to be stated layer may be condensed with another ring (for example 5- to 7-membered cycloalkene). For example, in formula (IX), $R_{25}$ and $R_{26}$, and in formula (X), $R_{27}$ and $R_{28}$, may cooperate to form a ring (for example, 5- to 7-membered cycloalkene, or benzene), respectively.

The magenta coupler represented by formula (I) preferably includes, for example, those represented by the following formulas (VI) to (XI):

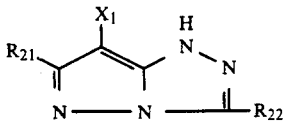

(VI)

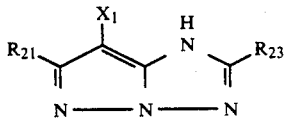

(VII)

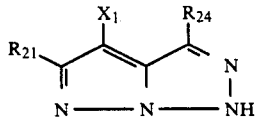

(VIII)

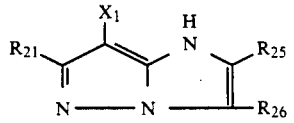

(IX)

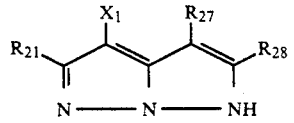

(X)

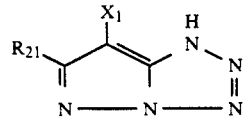

(XI)

wherein $R_{21}$ to $R_{28}$ and $X_1$ are the same in meaning as R and $X_1$ mentioned above, provided that $R_{21}$ to $R_{28}$ or $X_1$ may form a dimer or higher oligomers.

The magenta coupler of formula (I) is preferably one represented by the following formula (XII):

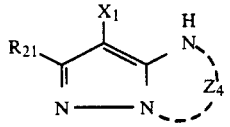

(XII)

wherein $R_{21}$, $X_1$ and $Z_4$ are the same in meaning as R, $X_1$ and $Z_1$ in formula (I).

Of the magenta couplers represented by formulas (VI) to (XII), those represented by formula (VI) are particularly preferable.

With respect to the substituent(s) on the heterocyclic ring in formulas (I) and (VI) to (XII), R in formula (I) and $R_{21}$ in formulas (VI) to (XII) preferably satisfy the following requirement 1, and more preferably, they satisfy the following requirements 1 and 2:

Requirement 1: The root atom bonded directly to the heterocyclic ring is a carbon atom.

Requirement 2: Said carbon atom has at least two hydrogen bonded thereto.

The most preferable substituents R and $R_{21}$ on the heterocyclic ring are those represented by the following formula (XIIA):

$R_{29}$—$CH_2$— (XIIA)

wherein $R_{29}$ represents a hydrogen atom, a halogen atom, an alkyl group, a cycloalkyl group, an alkenyl group, a cycloalkenyl group, an alkinyl group, an aryl group, a heterocyclic group, an acyl group, a sulfonyl group, a sulfinyl group, a phosphonyl group, carbamoyl group, a sulfamoyl group, a cyano group, a spiro-compound residue, a bridged hydrocarbon compound residue, an alkoxy group, an aryloxy group, a heterocyclicoxy group, a siloxy group, an acyloxy group, a carbamoyloxy group, an amino group, an acylamino group, a sulfonamide group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group or a heterocyclicthio group.

The group represented by $R_{29}$ may have a substituent(s). Examples of said group and said substituent(s) are the same as the examples of the group represented by R in formula (I) and the substituent(s) mentioned with respect thereto.

Preferable examples of $R_{29}$ are a hydrogen atom and an alkyl group.

The magenta coupler of the present invention is illustrated but is by no means limited, by the following examples.

1

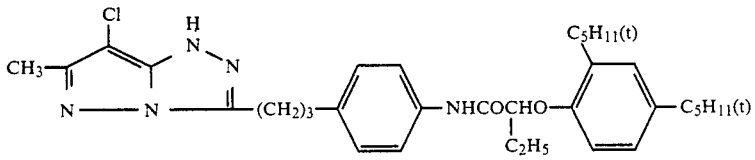

2

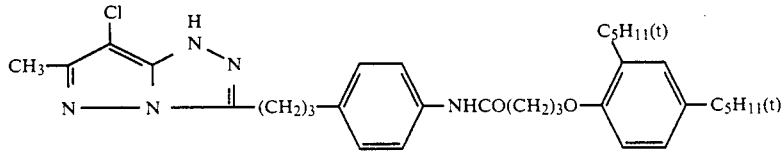

3

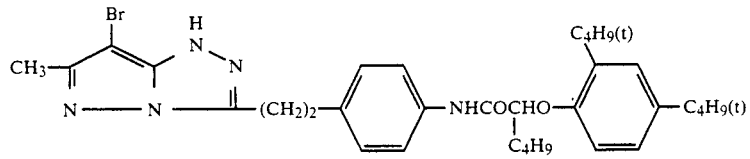

4

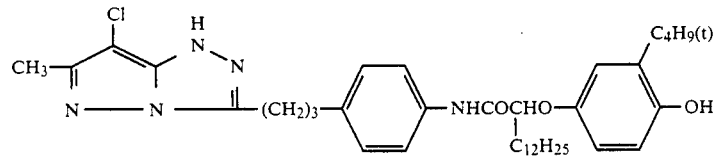

5

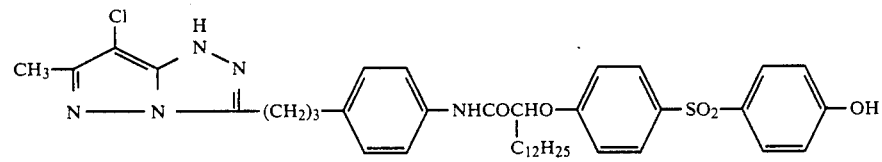

6

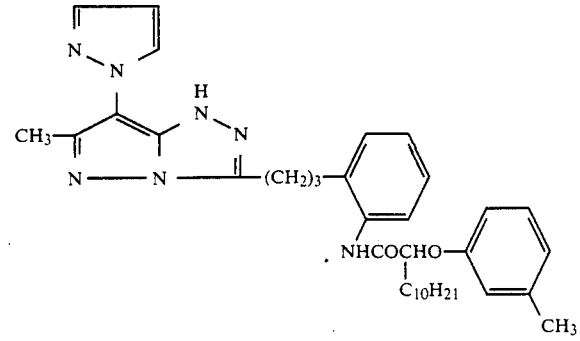

-continued
7
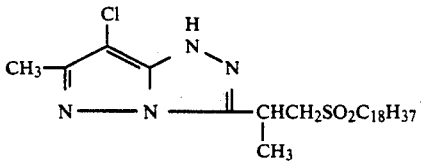
8
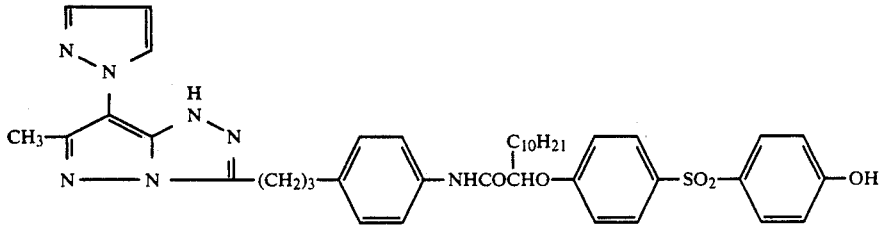
9
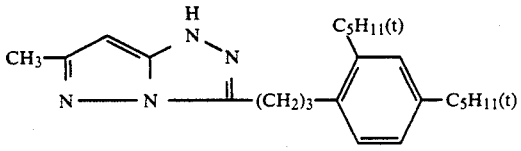
10
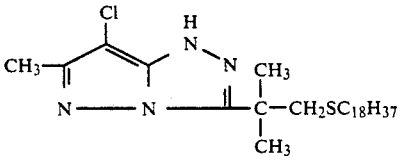
11
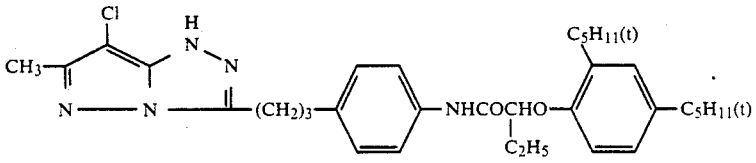
12
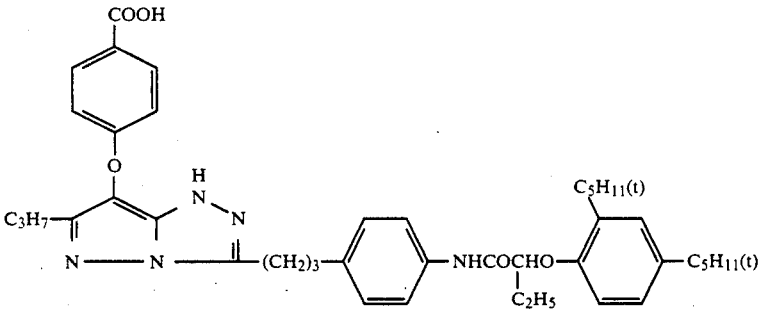
13
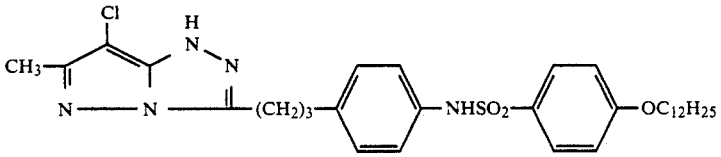
14
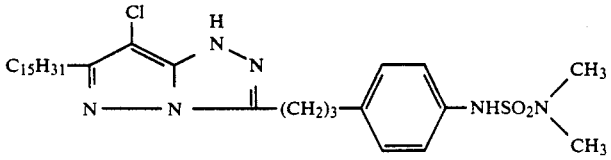
15
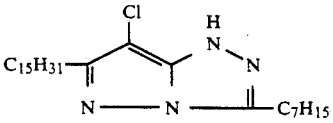

-continued
16
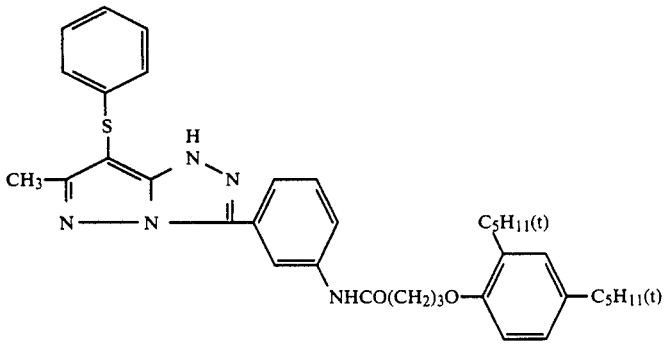
17
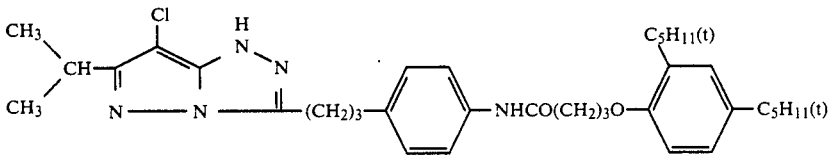
18
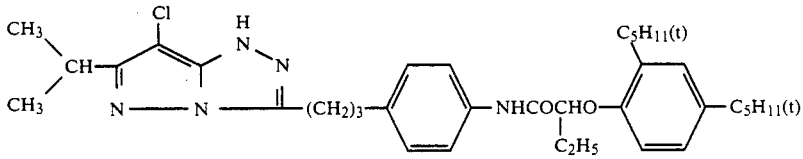
19
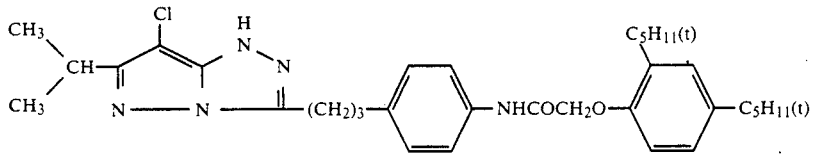
20
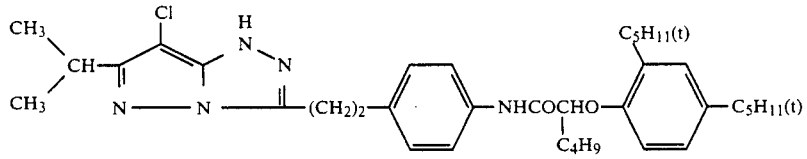
21
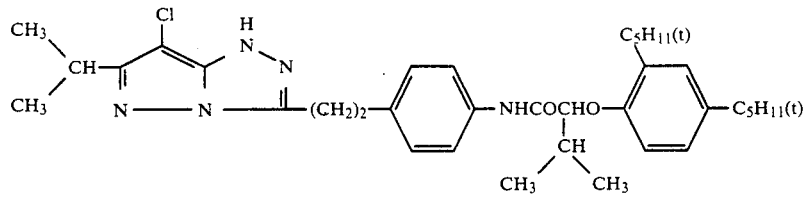
22
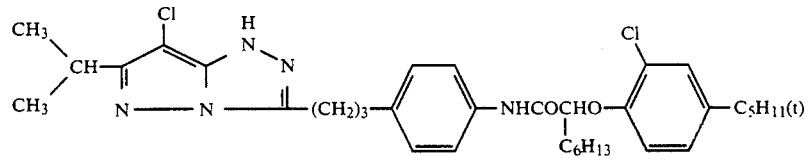
23
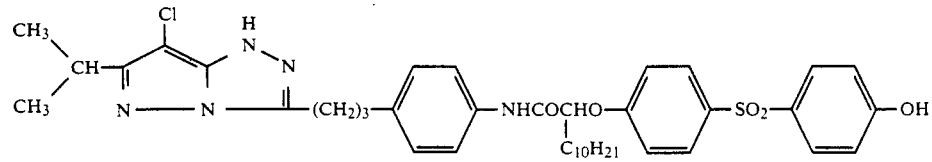

-continued
24
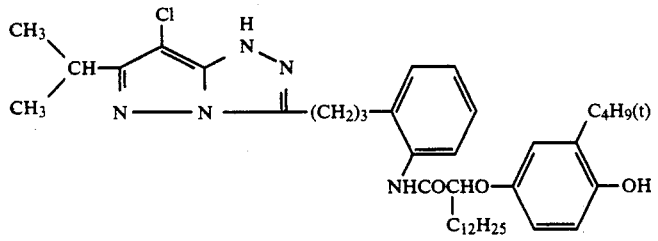
25
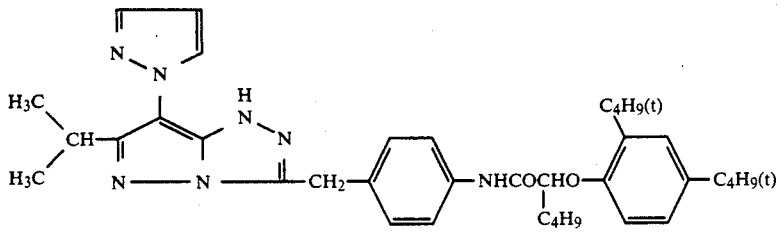
26
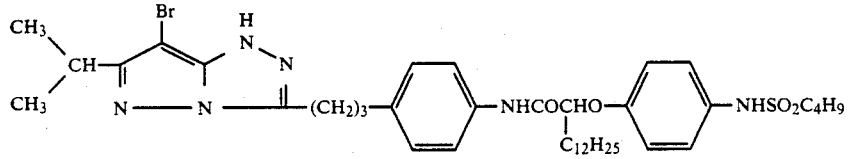
27
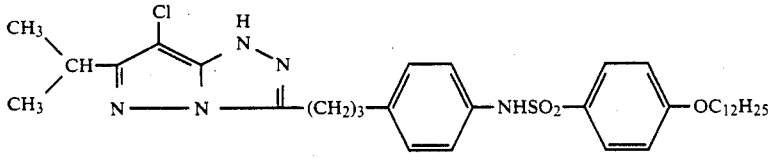
28
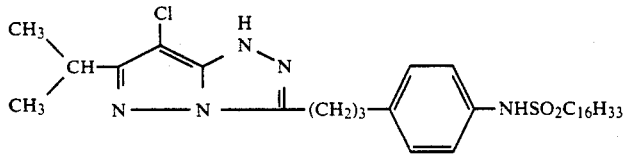
29
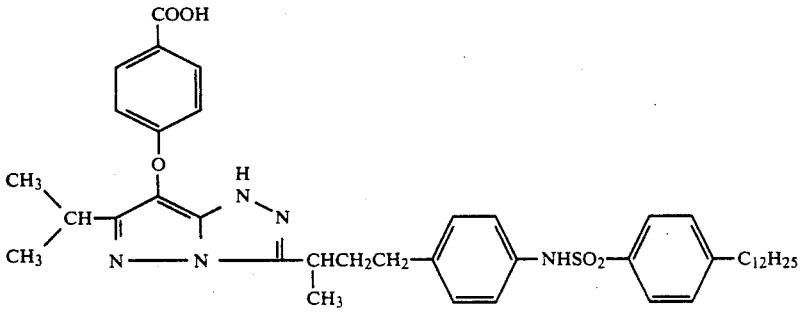
30
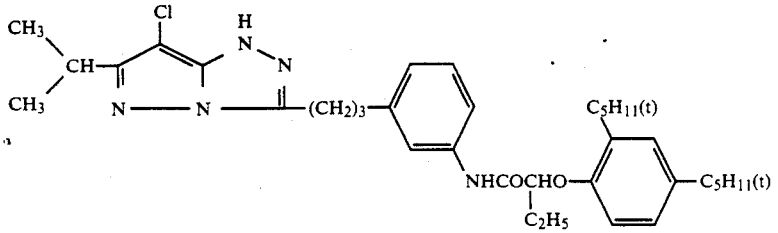

-continued
31
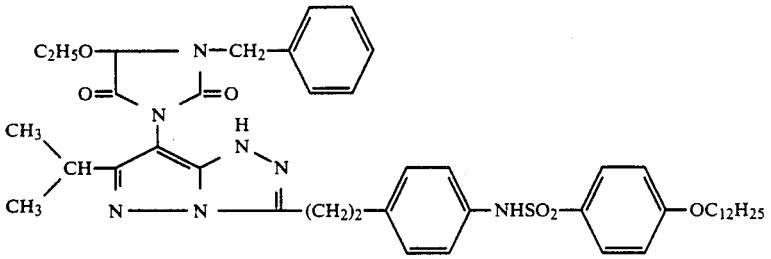
32
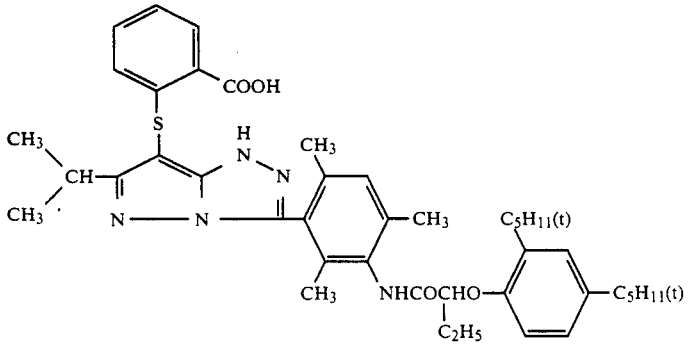
33
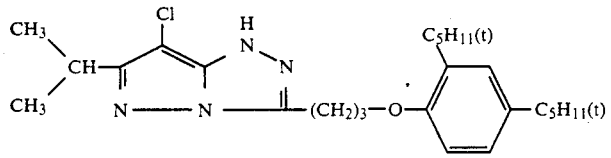
33
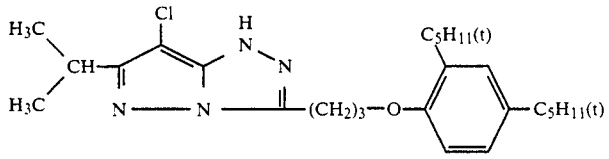
34
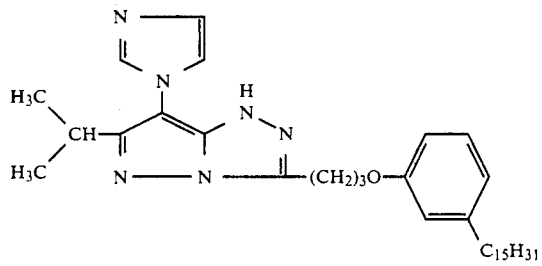
35
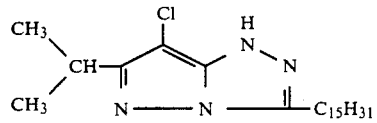
36
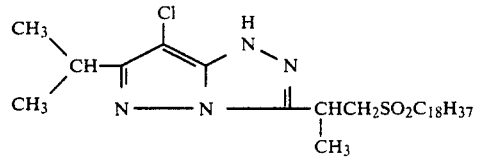
37
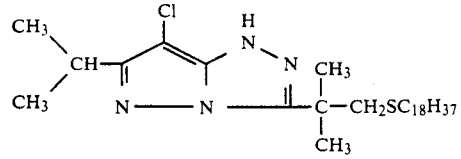

-continued
38
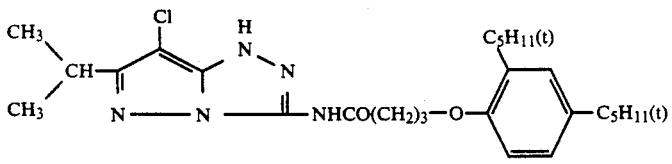
39
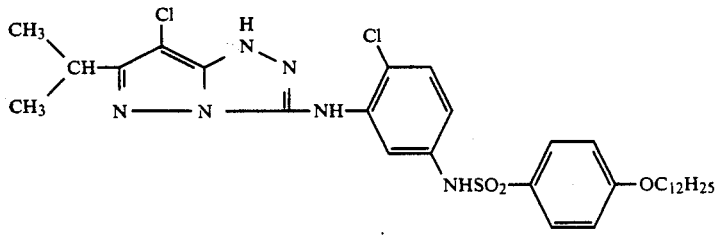
40
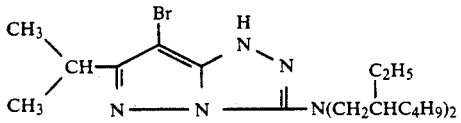
41
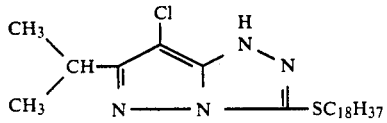
42
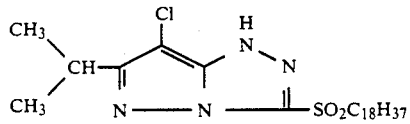
43
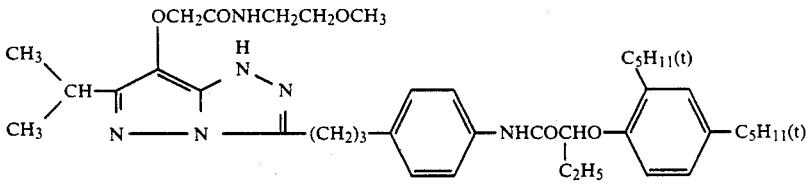
44
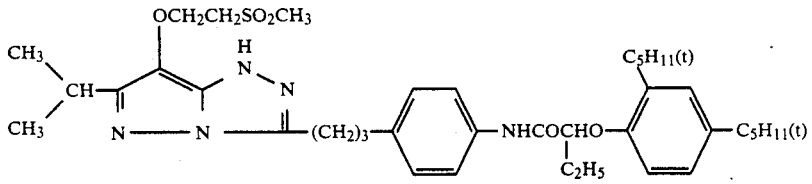
45
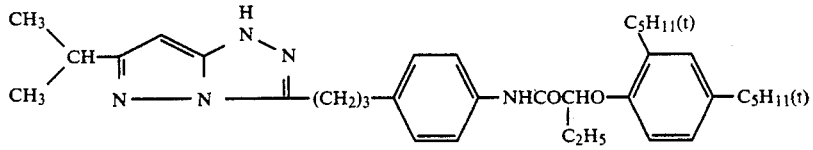
46
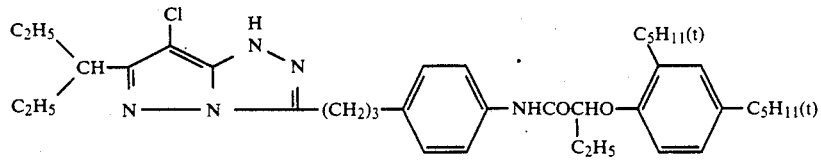

-continued
47
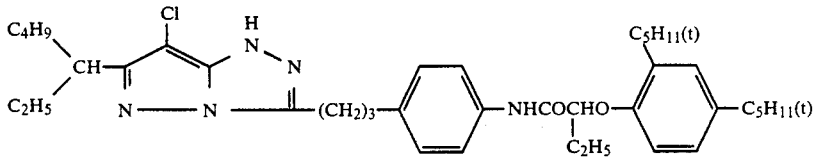
48
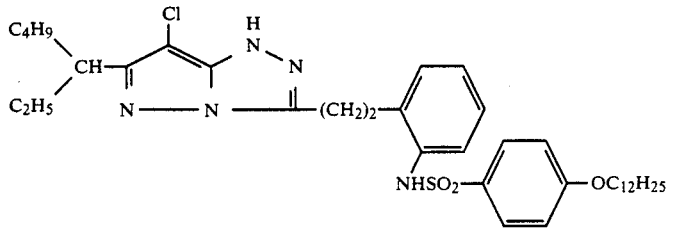
49
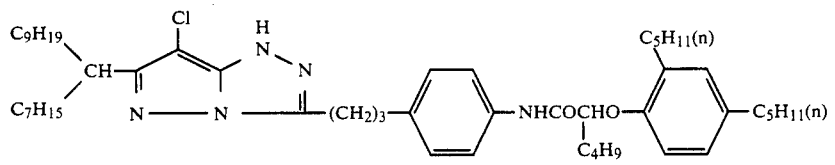
50
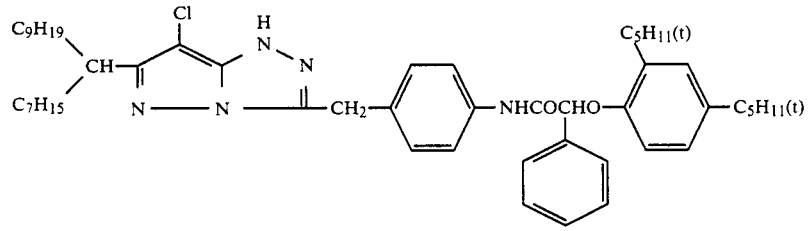
51
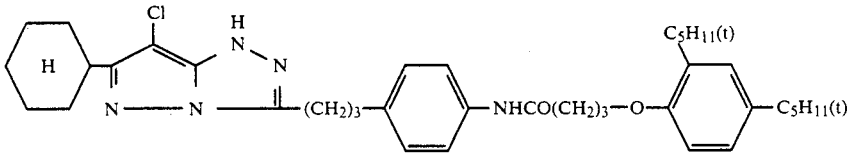
52
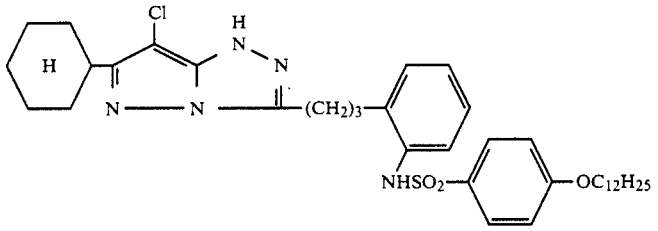
53
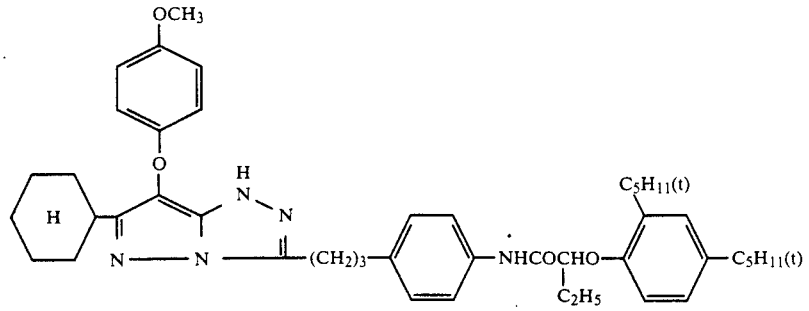

-continued
54
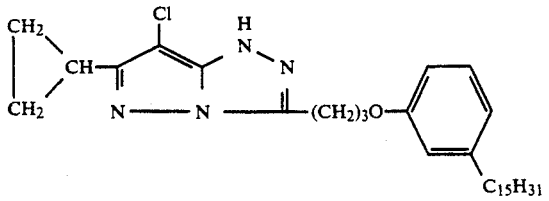
55
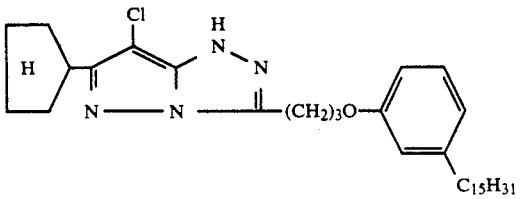
56
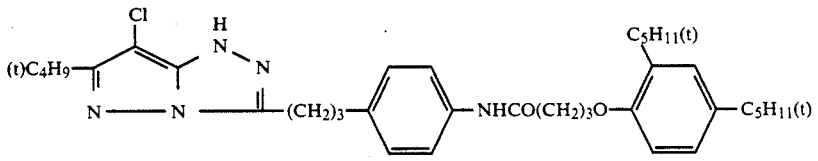
57
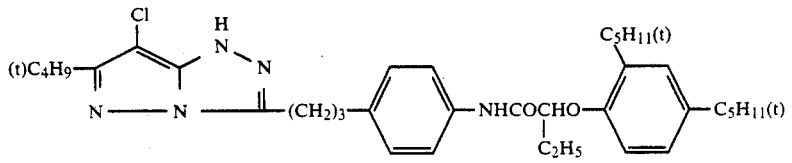
58
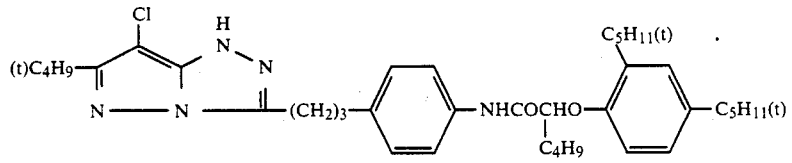
59
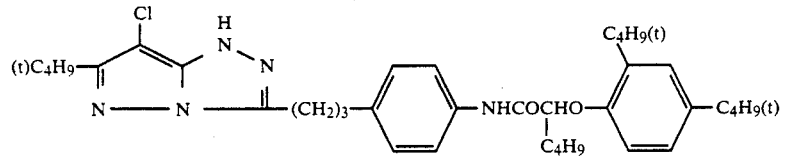
60
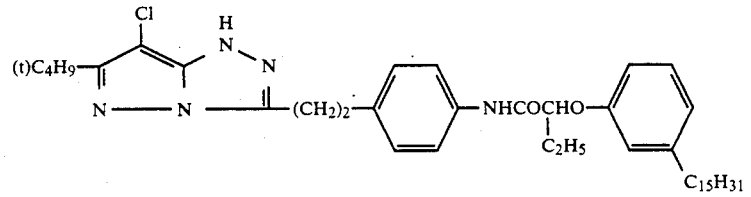
61
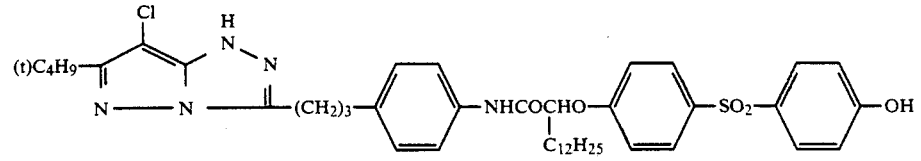
62
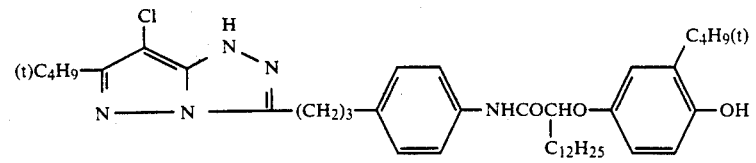

-continued
63
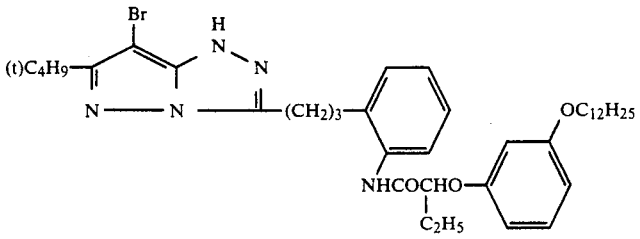
64
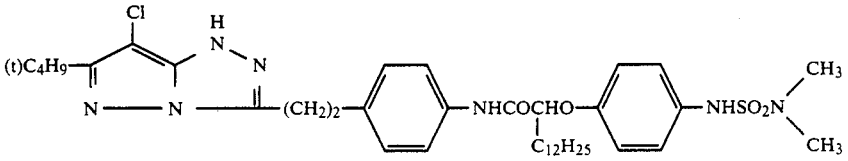
65
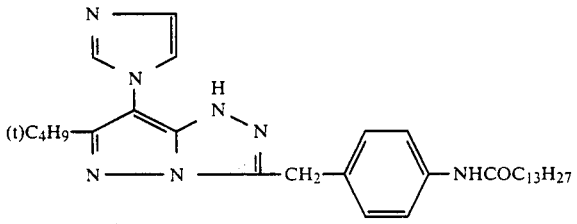
66
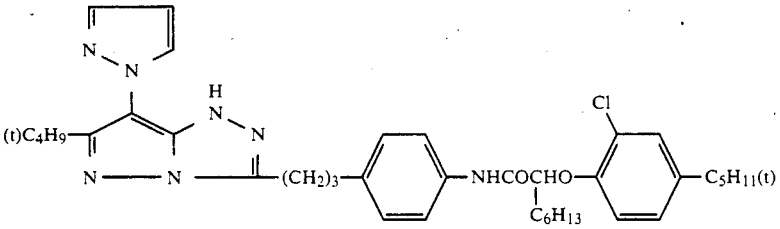
67
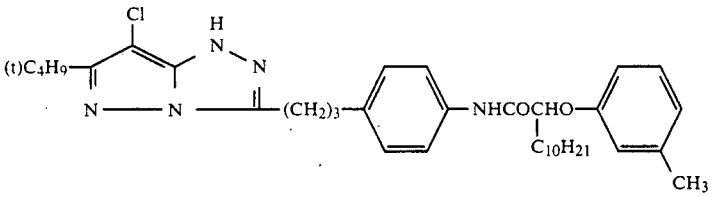
68
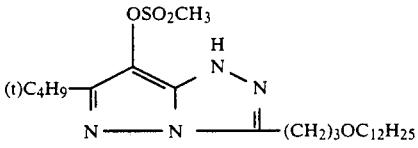
69
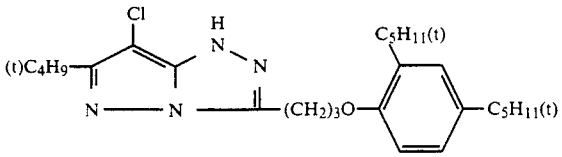

-continued
70
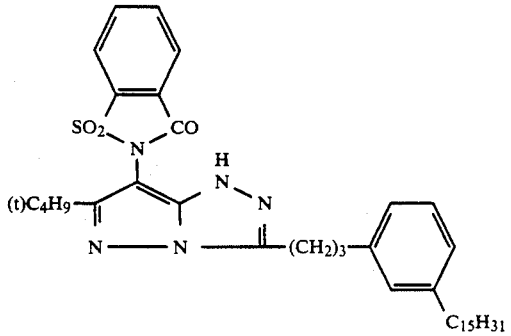
71
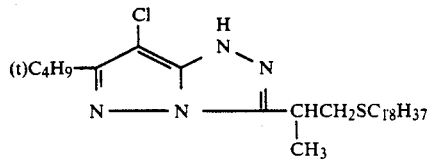
72
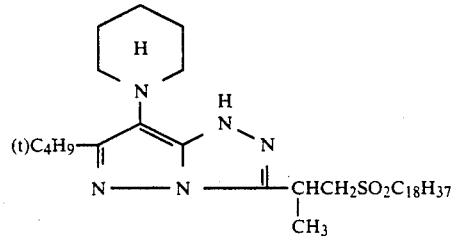
73
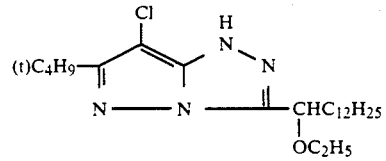
74
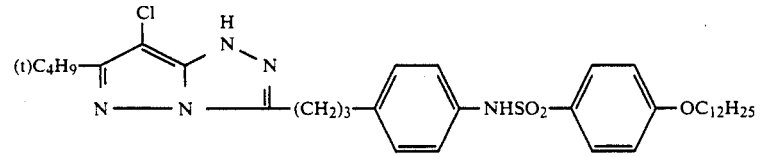
75
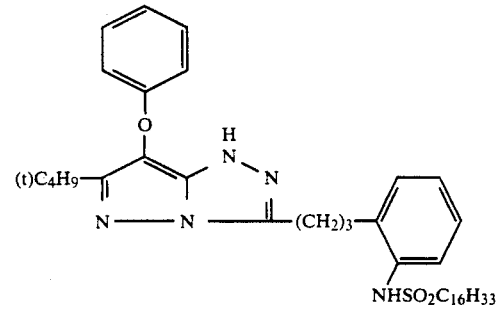
76
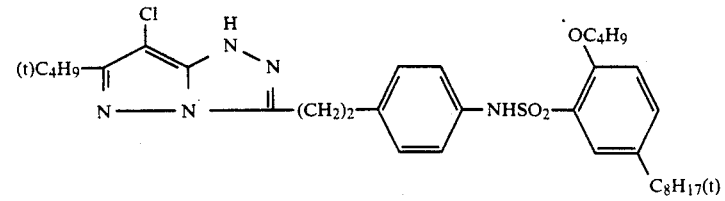

-continued
77
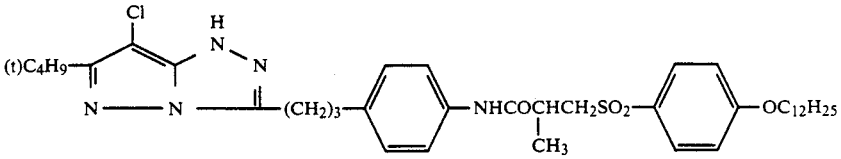
78
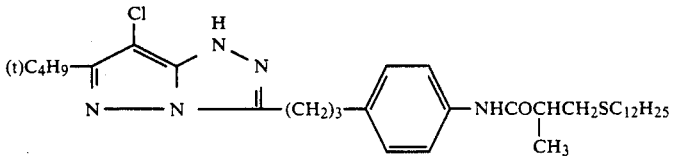
79
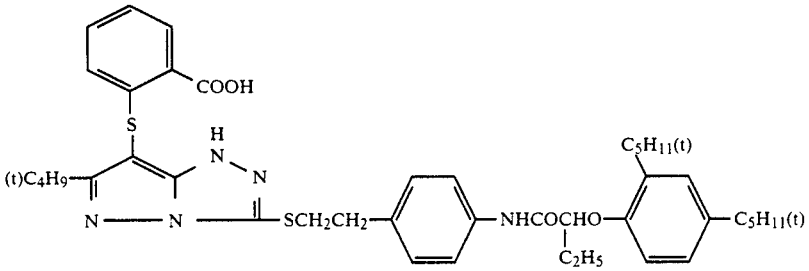
80
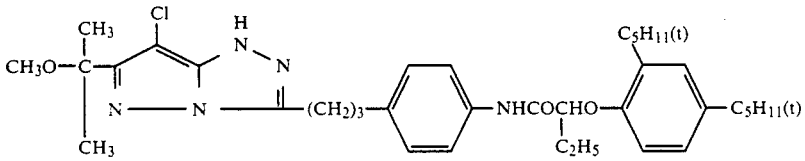
81
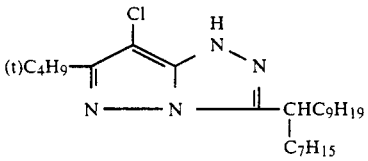
82
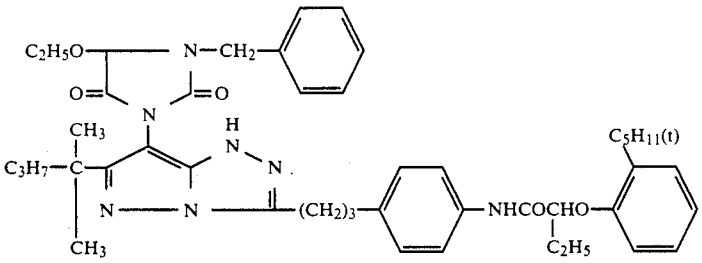
83
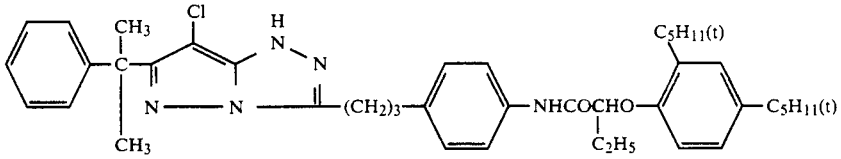
84
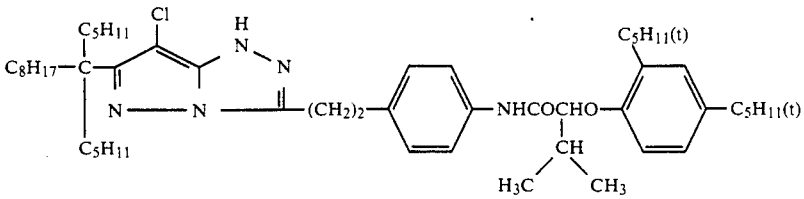

-continued
85
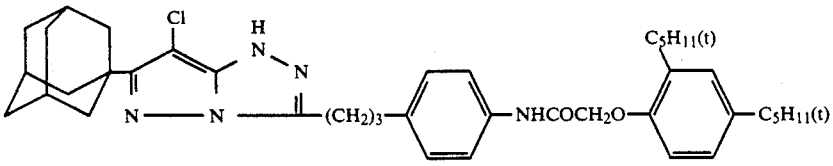
86
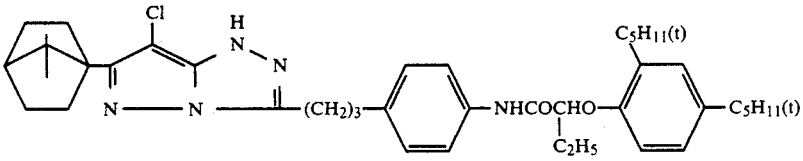
87
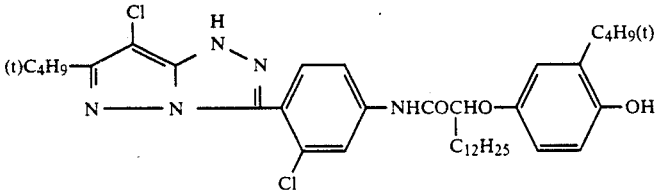
88
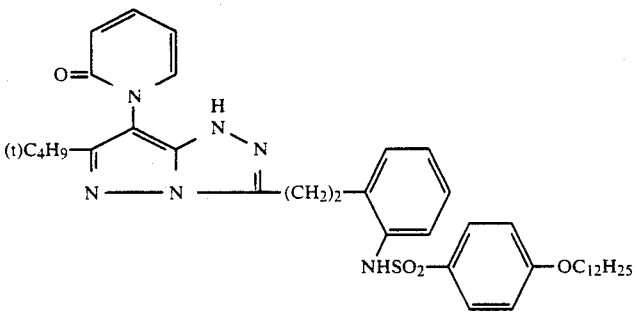
89
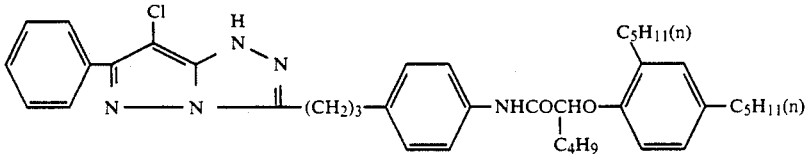
90
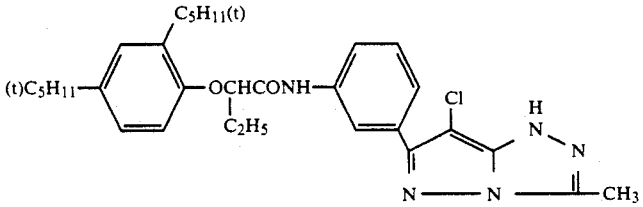
91
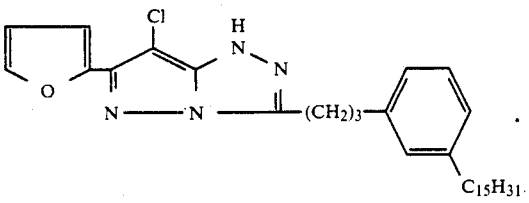

-continued
92
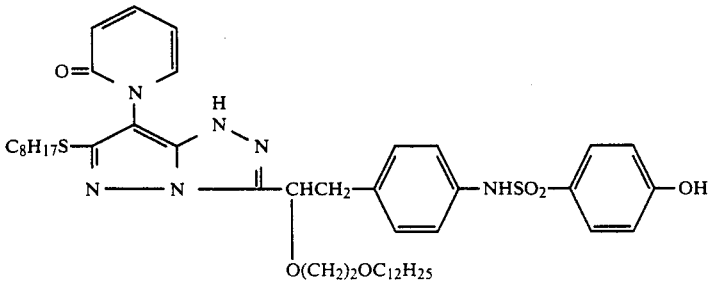
93
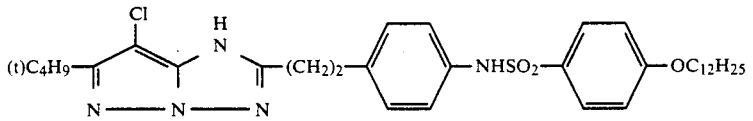
94
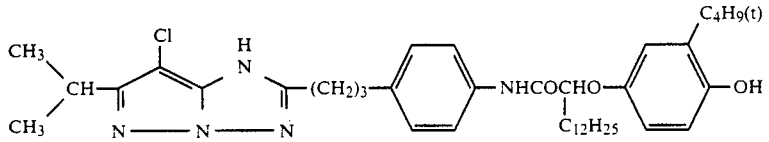
95
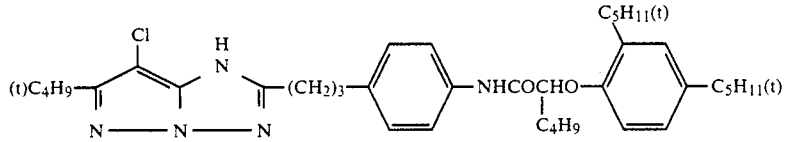
96
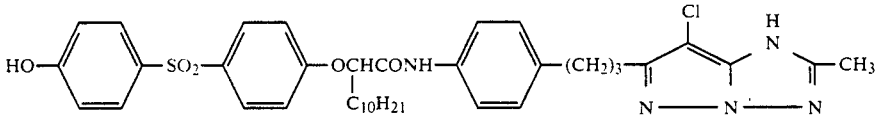
97
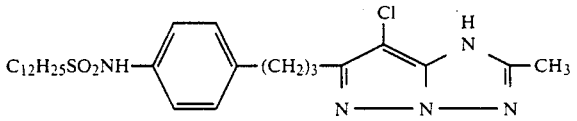
98
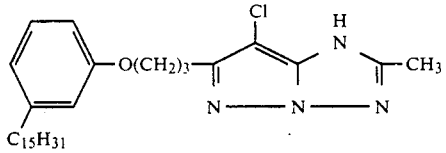
99
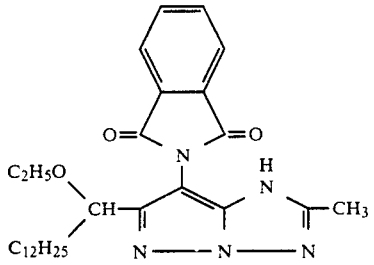
100
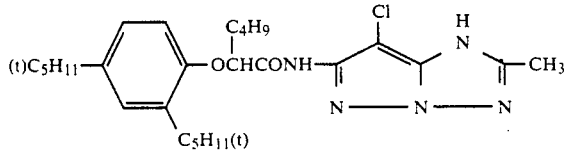

-continued
101
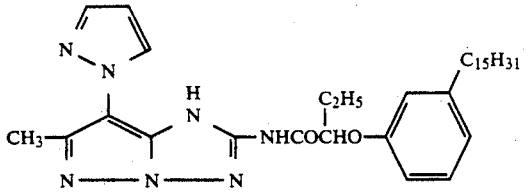
102
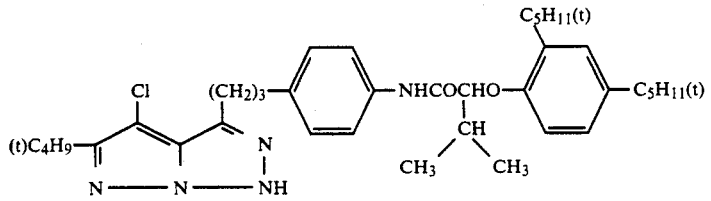
103
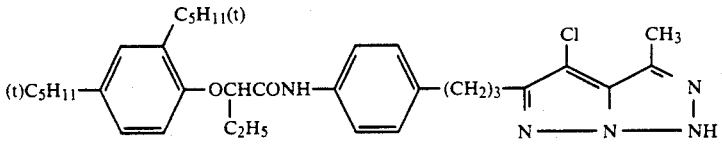
104
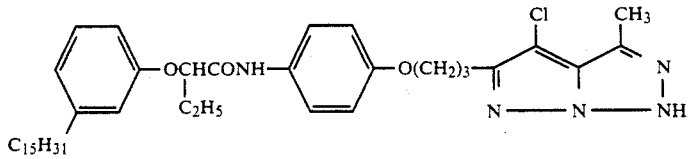
105
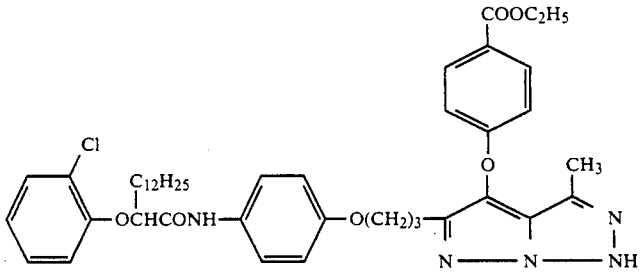
106
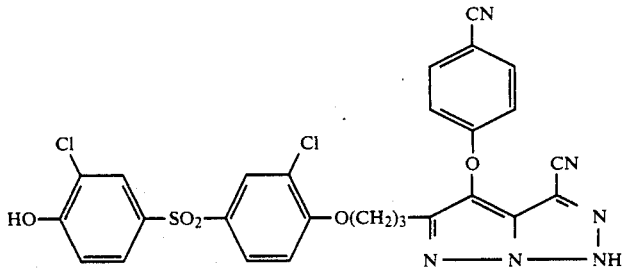
107
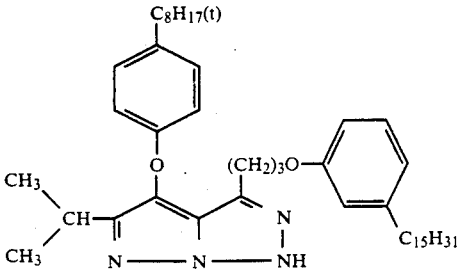

-continued
108
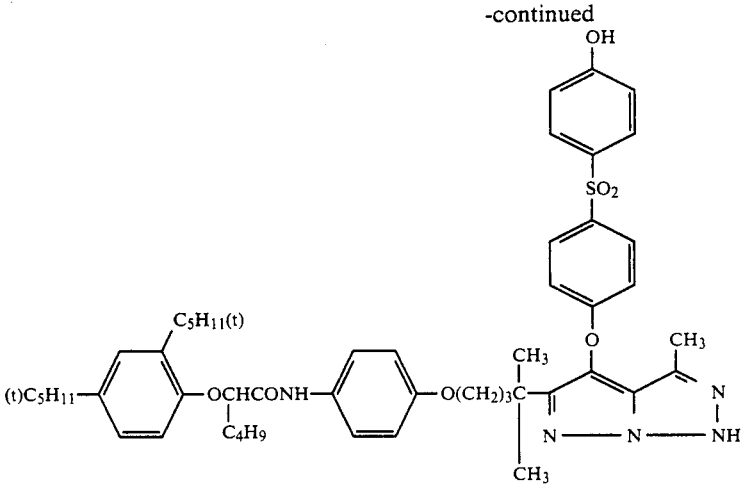
109
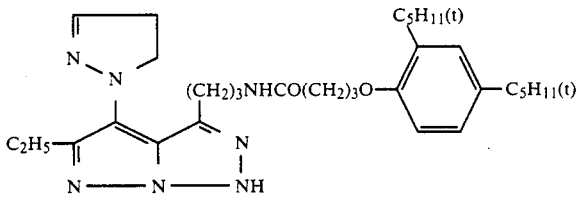
110
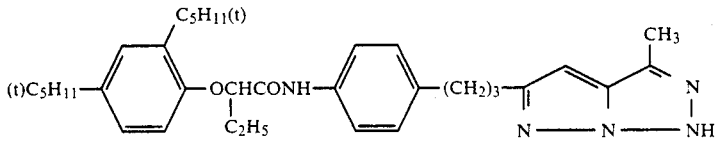
111
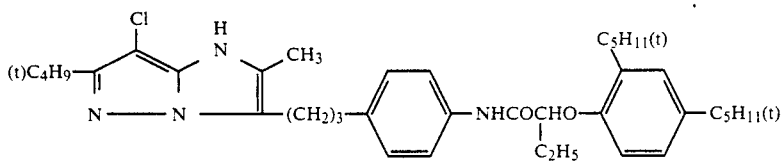
112
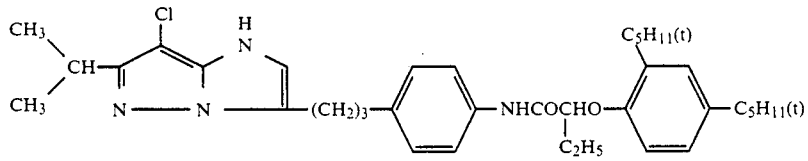
113
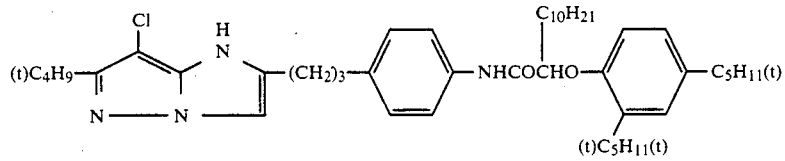
114
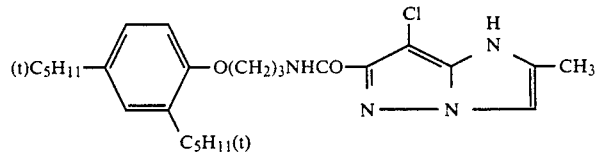
115
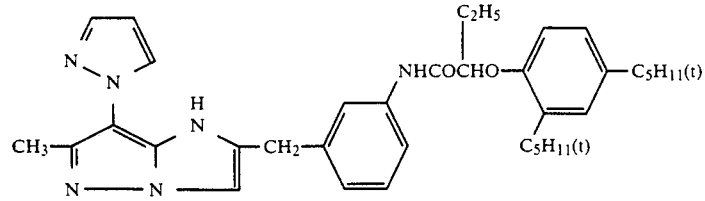

-continued
116
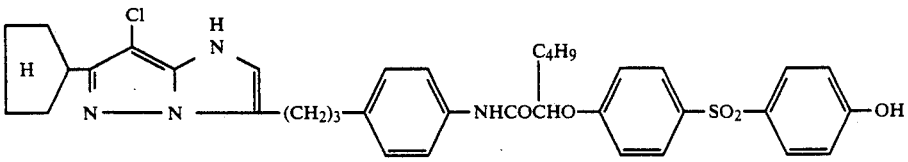
117
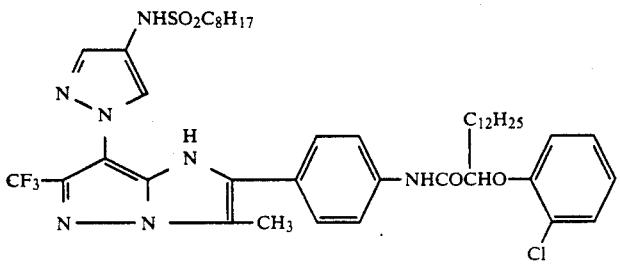
118
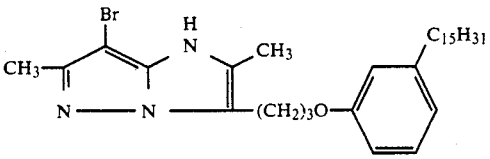
119
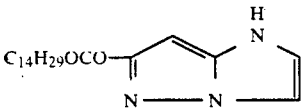
120
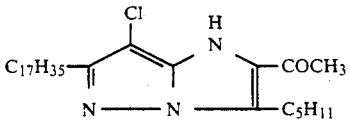
121
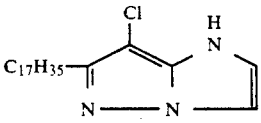
122
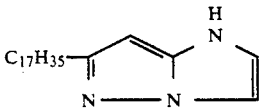
123
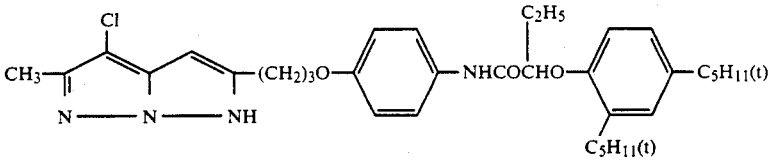
124
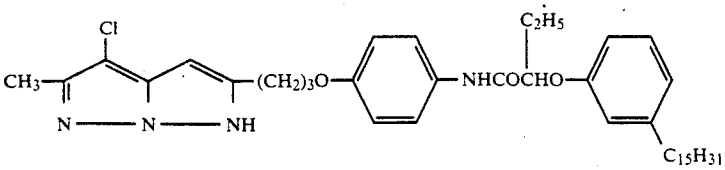

-continued
125
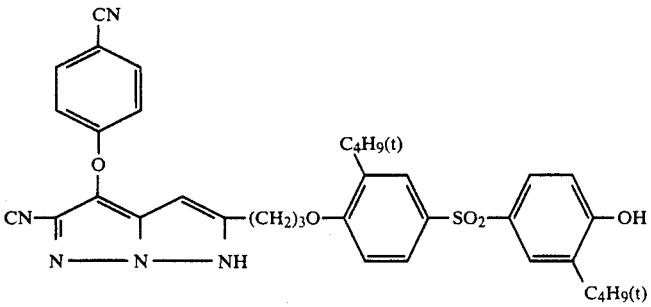
126
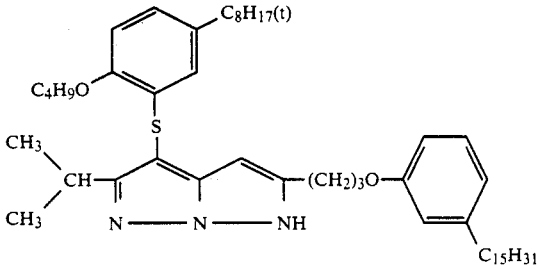
127
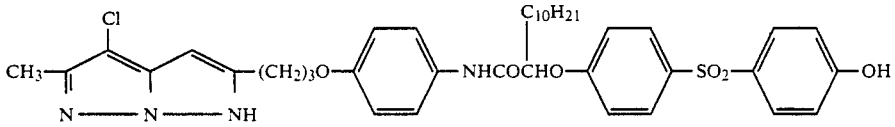
128
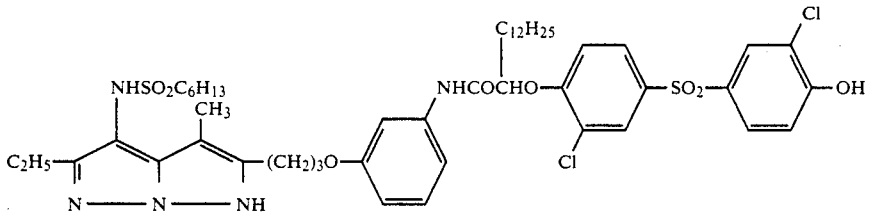
129
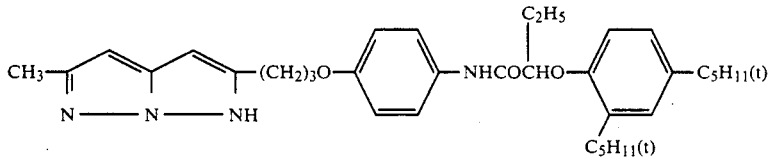
130
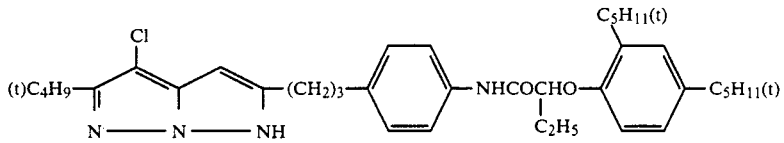
130
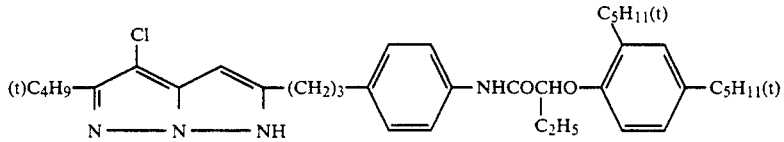
131
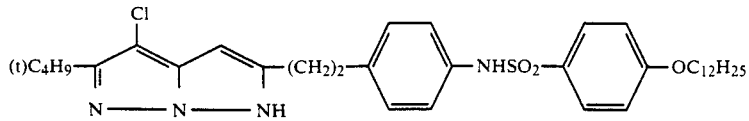

-continued
132
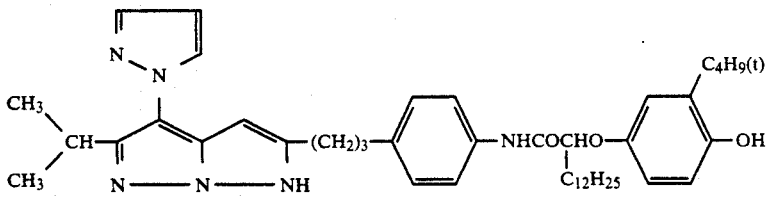
133
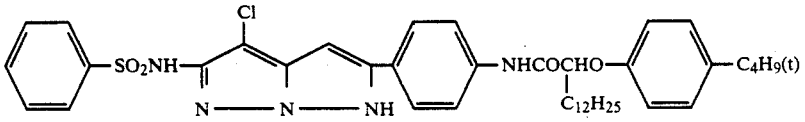
134
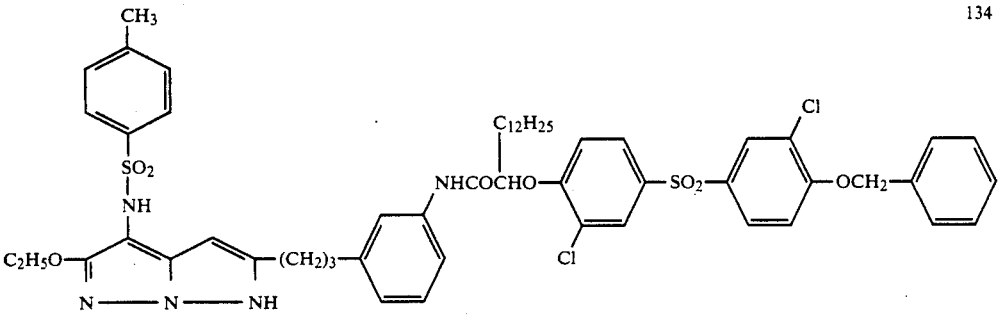
135
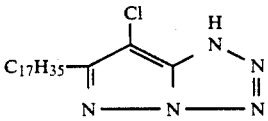
136
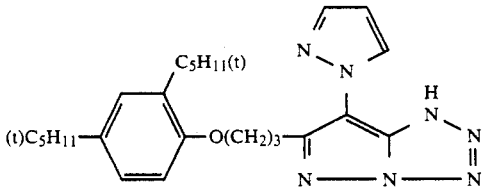
137
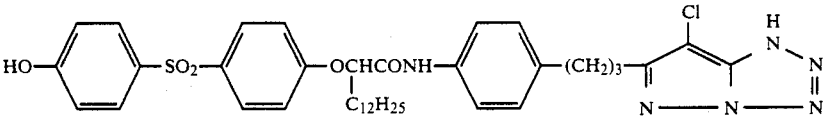
138
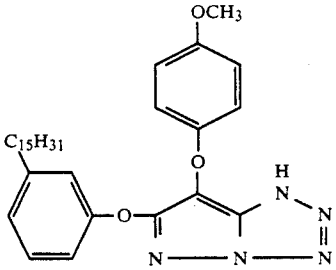
139
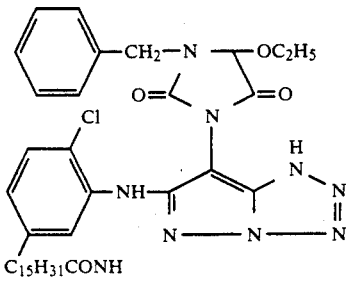

-continued

140

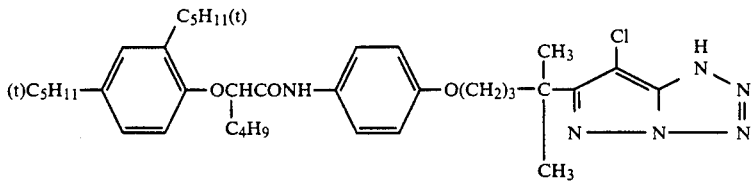

141

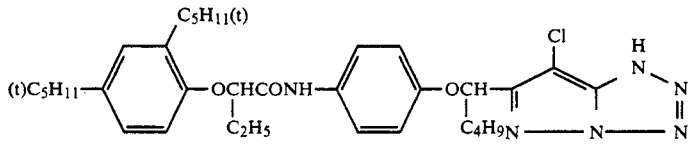

142

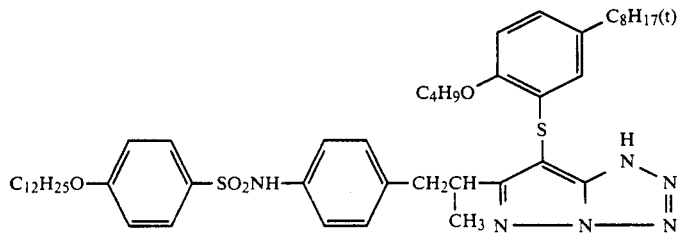

143

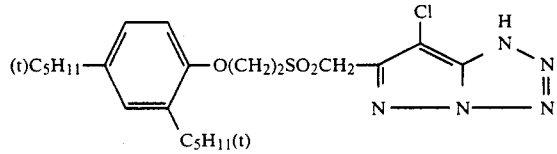

The above-listed couplers can be synthesized by reference to the methods described in Journal of the Chemical Society, Parkin I (1977), 2047–2052, U.S. Pat. No. 3,725,067, and Unexamined Published Japanese Patent Application Nos. 99437/1984 and 42045/1983.

The couplers of the present invention may be employed in amounts ranging from $1\times10^{-3}$ to 1 mole, preferably from $1\times10^{-2}$ to $8\times10^{-1}$ mole, per mole of silver halide.

The magenta coupler of the present invention may be used in combination with other types of magenta coupler. In other words, the green-sensitive silver halide emulsion layer in which the magenta coupler of the present invention is incorporated may also contain magenta couplers and/or colored magenta couplers which are outside the scope of the present invention. Such magenta couplers and/or colored magenta couplers that are outside the scope of the present invention are preferably incorporated in amounts less than 30 mol%, more preferably less than 15 mol%, of the total amount of the couplers employed.

Examples of the magenta coupler that may be incorporated in the green-sensitive silver halide emulsion together with the magenta coupler of the present invention include pyrazolone based compounds, indazolone based compounds, and cyanoacetyl based compounds, as well as those pyrazoloazole based compounds which are outside the scope of the present invention. Pyrazolone based compounds may be used with particular advantage.

Usable magenta couplers are specifically described in, for example, Unexamined Published Japanese Patent Application Nos. 111631/1974, 29236/1981 and 94752/1982; Japanese Patent Publication No. 27930/1973; U.S. Pat. Nos. 2,600,788, 3,062,653, 3,408,194 and 3,519,429; and Research Disclosure No. 12443.

Examples of the colored magenta coupler that may be incorporated in the green-sensitive silver halide emulsion layer together with the magenta coupler of the present invention are described in U.S. Pat. Nos. 2,801,171 and 3,519,429; and Japanese Patent Publication No. 27930/1973.

The magenta coupler of the present invention and other types of couplers are preferably used in amounts ranging from $2\times10^{-3}$ to 1 mole, more preferably from $1\times10^{-2}$ to $8\times10^{-1}$ mole, per mole of the silver in the emulsion layer. Such couplers may be incorporated in the green-sensitive silver halide layer by the oil-protected dispersion method or the latex dispersion method. If the couplers are alkali-soluble, they may be added in the form of an alkaline solution The silver halide emulsion used in the present invention may be a polydispersed emulsion wherein the grains have a board range of average size distribution but, more preferably, the emulsion is monodispersed The silver halide emulsion of the present invention may be used either independently or in combination with other types of emulsions, provided that the emulsion of the present invention is employed in an amount of less than 30 mol% of the total amount of the emulsions used.

In a preferred embodiment of the present invention, a mixture of two or more types of monodispersed silver halide grains may be incorporated in at least one of the blue-, green- and red-sensitive silver halide emulsion layers The two or more types of monodispersed silver halide grains may have the same or different average sizes. If desired, polydispersed silver halide grains may be used in combination with the monodispersed grains.

The light-sensitive material of the present invention may assume the "normal" arrangement of the light-sensitive emulsion layers Particularly good results are obtained if the emulsion layers are arranged in the "reverse" order (see, for example, Japanese Patent Application Nos. 193609/1984 and 202065/1984 filed by the applicant of subject application) With the "normal" arrangement of emulsion layers, it has so far been difficult to prevent the photographic characteristics (e.g., graininess) from varying as a result of changes in the conditions of development (e.g., pH), but the magenta coupler of the present invention is highly effective in avoiding such problems.

Each of the light-sensitive silver halide emulsion layers used in the present invention may be divided into two or more layers having different degrees of sensitivity. An illustrative arrangement consists, in order from the side farthest from the support, of a highly blue-sensitive silver halide emulsion layer (BH), a less blue-sensitive silver halide emulsion layer (BL), a highly green-sensitive silver halide emulsion layer (GH), a less green-sensitive silver halide emulsion layer (GL), a highly red-sensitive silver halide emulsion layer (RH), and a less red-sensitive silver halide emulsion layer (RL). Another possible arrangement consists, in order from the side farthest from the support, of a highly blue-sensitive silver halide emulsion layer (BH), a highly green-sensitive silver halide emulsion layer (GH), a highly red-sensitive silver halide emulsion layer (RH), a less blue-sensitive silver halide emulsion layer (BL), a less green-sensitive silver halide emulsion layer (GL), and a less red-sensitive silver halide emulsion layer (RL). The silver halide grains present in the BH, GH and RH in these layer arrangements, especially in the second arrangement, preferably have an average particle size of 0.40–3.00 μm more preferably 0.50–2.50 μm.

The silver halide grains present in the BL, GL and RL in the two layer arrangements, especially in the second arrangement, have an average particle size which preferably ranges from 0.20 to 1.50 μm, more preferably from 0.20 to 1.0 μm. If each of the BL, GL and RL is further divided into a layer of medium sensitivity and a layer of lowest sensitivity, the silver halide grains present in the former layer preferably have an average size of 0.30–1.50 μm while the grains in the latter layer preferably have an average size of 0.15–1.00 μm.

The monodispersed silver halide grains present in the blue-, green- and red-sensitive silver halide emulsion layers are such that most of the grains look alike in shape when the emulsions are observed under an electron microscope and that the grains are uniform in size and have such a size distribution that the value of $s/\bar{r}$ is 0.20 or below, preferably 0.15 or below, wherein s is the standard deviation of the size distribution and $\bar{r}$ is the arithmetic mean of sizes. The term "size" as used here has the same meaning as already defined in connection with the "average size" of silver halide grains: the "size" of a spherical silver halide grain is its diameter, and that of a cube or other non-spherical grains is the diameter of an equivalent circle having the same area of the projected image of that cubic or non-spherical grain.

The grain-size distribution of silver halide grains may be determined by the method described in Trivelli and Smith, "The Empirical Relationships Between Sensitometric Distribution and Grain-Size Distribution in Photography", The Photographic Journal, LXXIX, 330–338, 1949.

A mixture of two or more monodispersed emulsions may be incorporated in each of the layers of lowest sensitivity.

The silver halide emulsions used in the present invention may be chemically sensitized with activated gelatin, a sulfur sensitizer (e.g., allyl thiocarbamide, thiourea or crystine), a selenium sensitizer, a reduction sensitizer (e.g., stannous salts, thiourea dioxide or polyamines), a noble metal sensitizer such as a gold sensitizer (e.g., potassium aurithiocyanate, potassium chloroaurate, or 2-aurothio-3-methylbenzothiazolium chloride) or water-soluble salts of other noble metals such as ruthenium, palladium, platinum, rhodium and iridium (e.g., ammonium chloropalladate, potassium chloroplatinate and sodium chloropalladate), some of which will act eigher as sensitizers or as anti-foggants depending on the amount in which they are used. These chemical sensitizers may be used either independently or in combination (an illustrative combination is that of a gold sensitizer and a sulfur sensitizer, or that of a gold sensitizer and a selenium sensitizer).

The silver halide emulsions in accordance with the present invention may be chemically ripened by addition of a sulfur-containing compound, with at least one hydroxytetrazaindene compound and at least one nitrogenous heterocyclic compound containing a mercapto group being optionally incorporated in the emulsions either prior to, during or after the chemical ripening.

The silver halide emulsions used in the present invention may be provided with sensitivity to the desired wavelength ranges by means of optical sensitization through the addition of from $5\times10^{-8}$ to $3\times10^{-3}$ mole of appropriate sensitizing dyes per mole of silver halide. A variety of sensitizing dyes may be employed, and two or more dyes may be used in combination. The following sensitizing dyes may be used with advantage in the present invention.

Illustrative sensitizing dyes that may be incorporated in the blue-sensitive silver halide emulsion layer are described in German Patent No. 929,080, U.S. Pat. Nos. 2,231,658, 2,493,748, 2,503,776, 2,519,001, 2,912,329, 3,656,959, 3,672,897, 3,694,217, 4,025,349 and 4,046,572; British Patent No. 1,242,588; and Japanese Patent Publication Nos. 14030/1969 and 24844/1977. Typical examples of the sensitizing dyes that may be incorporated in the green-sensitive silver halide emulsion layer are cyanine dyes, merocyanine dyes and complex cyanine dyes of the types described in U.S. Pat. Nos. 1,939,201, 2,072,908, 2,739,149 and British Patent No. 505,979. Typical examples of the sensitizing dyes that may be incorporated in the red-sensitive silver halide emulsion layer are cyanine dyes, merocyanine dyes and complex cyanine dyes of the types described in U.S. Pat. Nos. 2,269,234, 2,270,378, 2,442,710, 2,454,629 and 2,776,280. Cyanine dyes, merocyanine dyes and complex cyanine dyes of the types described in U.S. Pat. Nos. 2,213,995, 2,493,748 and 2,519,001, and German Patent No. 929,080 may also be used with advantage in the green- or red-sensitive silver halide emulsion.

These sensitizing dyes may be used either independently or in combination.

The photographic light-sensitive material of the present invention may optionally be given spectral sensitization in a desired wavelength range by independent or combined use of cyanine or merocyanine dyes. A particularly preferable method of spectral sensitization involves the use of benzimidazolocarbocyanine and benzoxazolocarbocyanine in combination, and examples of this method are described in Japanese Patent Publication Nos. 4936/1968, 22884/1968, 18433/1970, 37443/1972, 28293/1973, 6209/1974 and 12375/1978; and Unexamined Published Japanese Patent Application Nos. 23931/1977, 51932/1977, 80118/1979, 153926/1983, 116646/1984 and 116647/1984.

Another typical method of spectal sensitization relies on the combined use of a carbocyanine having a benzimidazole nucleus and another cyanine or merocyanine, and examples of the method are described in Japanese Patent Publication Nos. 25831/1970, 11114/1972, 25379/1972, 38406/1973, 38407/1973, 34535/1979 and 1569/1980; and Unexamined Published Japanese Patent Application Nos. 33220/1975, 38526/1975, 107127/1976, 115820/1976, 135528/1976, 104916/1977 and 104917/1977.

Methods using benzoxazolocarbocyanine (oxacarbocyanine) in combination with other carbocyanines are shown in Japanese Patent Publication Nos. 32753/1969 and 11627/1971, and Unexamined Published Japanese Patent Application No. 1483/1972. Methods using merocyanines are described in Japanese Patent Publication Nos. 38408/1973, 41204/1973 and 40662/1975; and Unexamined Published Japanese Patent Application Nos. 25728/1981, 10753/1983, 91445/1983, 116645/1984 and 33828/1975.

Methods relying on the combined use of thiacarbocyanine and other carbocyanines are described in Japanese Patent Publication Nos. 4932/1968, 4933/1968, 26470/1970, 18107/1971 and 8741/1972; and Unexamined Published Japanese Patent Application No. 114533/1984. Zeromethine or dimethine merocyanine, monomethine or trimethine cyanine and styryl dyes may be used with advantage as described in Japanese Patent Publication No. 6207/1974.

The aforementioned sensitizing dyes are incorporated in the silver halide emulsion of the present invention in the form of dye solutions wherein such dyes are dissolved in hydrophilic organic solvents such as methyl alcohol, ethyl alcohol, acetone, dimethylformamide, or the fluorinated alcohol described in Japanese Patent Publication No. 40659/1975.

The sensitizing dyes may be incorporated in the silver halide emulsion at any stage of emulsion preparation prior to, during or after chemical ripening. If desired, they may be added in the step immediately before the application of the emulsion.

The silver halide photographic material of the present invention may incorporate water-soluble dyes in a hydrophilic colloid layer either as filter dyes or for the purpose of accomplishing various functions such as prevention of irradiation. Suitable water-soluble dyes include oxonol, hemioxonol, merocyanine and azo dyes, with oxonol, hemioxonol and merocyanine dyes being particularly useful. Specific examples of the usable dyes are listed in British Patent Nos. 584,609 and 1,277,429; Unexamined Published Japanese Patent Application Nos. 85130/1973, 99620/1974, 114420/1974, 129537/1974, 108115/1977 and 25845/1984; and U.S. Pat. Nos. 2,274,782, 2,533,472, 2,956,879, 3,125,448, 3,148,187, 3,177,078, 3,247,127, 3,540,887, 3,575,704, 3,653,905, 3,718,472, 4,071,312 and 4,070,352.

The silver halide photographic material of the present invention may contain blue- and red-sensitive silver halide emulsion layers in combination with the green-sensitive silver halide emulsion layer incorporating the magenta coupler of formula (I). Each of the blue- and red-sensitive silver halide emulsion layers may contain an appropriate coupler, or a compound which is capable of reacting with the oxidation product of a color developing agent to form a dye.

The blue-sensitive silver halide emulsion layer preferably contains a yellow dye forming coupler, and known open-chain ketomethylene compounds may be used as yellow couplers. Advantageous yellow couplers are benzoylacetanilide and pivaloylacetanilide compounds. For specific examples of the yellow coupler, see Unexamined Published Japanese Patent Application Nos. 26133/1972, 29432/1973, 87650/1975, 17438/1976, and 102636/1976; Japanese Patent Publication Nos. 19956/1970, 19031/1971, 33410/1976 and 10783/1976; and U.S. Pat. Nos. 2,875,057, 3,408,194 and 3,519,429.

Cyan couplers which are suitable for use in the red-sensitive silver halide emulsion layer are phenolic and naphtholic compounds. Specific examples of the suitable cyan coupler are described in U.S. Pat. Nos. 2,423,730, 2,474,293 and 2,895,826; and Unexamined Published Japanese Patent Application No. 117422/1975.

These cyan couplers may be used in combination with customary colored cyan couplers such as those described in Japanese Patent Publication No. 32461/1980 and British Patent No. 1,084,480.

In a preferred embodiment of the present invention, a compound that releases a development inhibitor or its precursor upon reaction with the oxidation product of a color developing agent (such compound is hereunder referred to as the DIR compound) is incorporated in at least one of the light-sensitive silver halide emulsion layers. In a more preferred embodiment, such DIR compound is incorporated in at least one of blue-, green- and red-sensitive silver halide emulsion layers of high sensitivity, BH, GH and RH.

Typical examples of such DIR compound are DIR couplers having at the active site a group capable of forming a development inhibiting compound upon leaving said active site; such DIR couplers are described in British Patent No. 935,454, U.S. Pat. Nos. 3,227,554, 4,095,984 and 4,149,886; and Unexamined Published Japanese Patent Application No. 151944/1982. These DIR couplers have such properties that when entering into coupling reaction with the oxidation product of a color developing agent, the coupler nucleus forms a dye while releasing a development inhibitor. Also included in the scope of the invention are compounds that, when coupling with the oxidation product of a color developing agent, release a development inhibitor but do not form a dye, as described in U.S. Pat. Nos. 3,852,345, 3,928,041, 3,958,993, 3,961,959 and 4,052,213; and Unexamined Published Japanese Patent Application Nos. 110529/1978, 13333/1979 and 161237/1980.

Timed DIR compounds may also be used in the present invention; they are such compounds that, when reacting with the oxidation product of a color developing agent, the nucleus forms a dye or a colorless compound while the leaving timing group releases a development inhibitor by intramolecular nucleophilic displacement reaction or elimination reaction. Such timed DIR compounds are described in Unexamined Published Japanese Patent Application Nos. 145135/1979, 114946/1981 and 154234/1982.

Other timed DIR compounds that may be used in the present invention are of the type described in Unexamined Published Japanese Patent Application Nos. 160954/1983 and 162949/1983; they are such that the timing group as defined above is bonded to the coupler nucleus that forms a completely diffusible dye upon reaction with the oxidation product of a color developing agent.

The DIR compounds which are particularly preferred for the purpose of the present invention are represented by the following formulas (XIV) and (XV), with the compounds of formula (XV) being most preferred: DIR compound formula (XIV)

Coup - inhibitor wherein Coup is a coupler component (compound) capable of coupling with the oxidation product of a color developing agent and is illustrated by open-chain ketomethylene compounds such as acylacetanilides and acylacetate esters; dye forming couplers such as pyrazolones, pyrazolotriazoles, pyrazolinobenzimidazoles, indazolones, phenols and naphthols; and substantially non-dye forming coupling components such as acetophenones, indanones and oxazolones;

the "inhibitor" is a component (compound) that, upon reaction with the color developing agent, leaves the compound of (XIV) so as to inhibit the development of silver halide; preferred compounds are heterocyclic compounds and heterocyclic mercapto compounds such as benzotriazole and 3-octylthio-1,2,4-triazole.

Illustrative heterocyclic groups in these heterocyclic compounds and heterocyclic mercapto compounds include tetrazolyl, thiadiazolyl, oxadiazolyl, thiazolyl, oxazolyl, imidazolyl and triazolyl, and more specific examples are 1-phenyltetrazolyl, 1-ethyltetrazolyl, 1-(4-hydroxyphenyl)tetrazolyl, 1,3,4-thiazolyl, 5-methyl-1,3,4-oxadiazolyl, benzthiazolyl, benzoxazolyl, benzimizolyl and 4H-1,2,4-triazolyl.

In formula (XIV), the "inhibitor" is bonded to the active site of Coup. DIR compound formula (XV)

Coup - TIME - inhibitor wherein the "inhibitor" has the same meaning as defined for formula (XIV): Coup is the same as defined for formula (XIV) and includes coupler components that form completely diffusible dyes; TIME is illustrated by, but not limited to, the groups represented by the following formulas (XVI), (XVII), (XVIII) and (XIX); DIR compound formula (XVI)

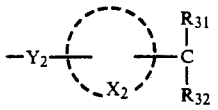

wherein $X_2$ represents the atomic group necessary for complete formation of a benzene or naphthalene ring; $Y_2$ represents —O—, —S—,

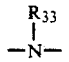

(wherein $R_{33}$ is a hydrogen atom, an alkyl group or an aryl group) and is bonded to the coupling site; $R_{31}$ and $R_{32}$ represent groups which have the same meaning as $R_{33}$, except that

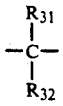

is in the position ortho or para to $Y_2$ and bonded to a hetero atom in the inhibitor;

DIR compound formula (XVII)

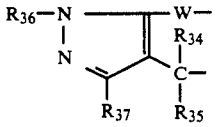

wherein W is the same as defined for Y in formula (XVI); $R_{34}$ and $R_{35}$ respectively have the same meanings as those of $R_{31}$ and $R_{32}$ defined for formula (XVI); $R_{36}$ is a hydrogen atom, an alkyl group, an aryl group, an acyl group, a sulfon group, an alkoxycarbonyl group, or a heterocyclic residue; $R_{37}$ is a hydrogen atom, an alkyl group, an aryl group, a heterocyclic residue, an alkoxy group, an amino group, an acylamido group, a sulfonamido group, a carboxy group, an alkoxycarbonyl group, a carbamoyl group or a cyano group; the timing group of formula (XVII) is bonded to the coupling site of Coup by W and to a hetero atom in the inhibitor by

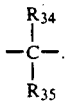

A timing group that releases an inhibitor by intra molecular nucleophilic displacement reaction may be represented by formula (XVIII);

DIR compound formula (XVIII)

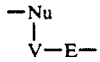

wherein Nu is a nucleophilic group having an electron-rich oxygen, sulfur or nitrogen atom and is bonded to the coupling site of Coup; E is an electrophilic group having an electron-deficient carbonyl, thiocarbonyl, phosphinyl or thiophosphinyl group and is bonded to a hetero atom in the inhibitor; V is a bonding group that sterically relates Nu to E in such a manner that after Nu is released from Coup, V is subjected to intramolecular nucleophilic displacement reaction involving the formation of a 3- to 7-membered ring, thereby causing the release of the inhibitor; DIR compound formula (XIX)

Coup - $OCH_2$ - inhibitor wherein Coup and inhibitor have the same meanings as defined above.

The DIR compounds listed above are preferably incorporated in the light-sensitive silver haide emulsion layers.

Two or more of these DIR compounds may be incorporated in the same layer; alternatively, the same DIR compound may be incorporated in one or more layers.

These DIR compounds are preferably used in amounts of $2\times10^{-4}$ to $5\times10^{-1}$ moles per mole of silver in an emulsion layer, with the range of $2\times10^{-4}$ to $5\times10^{-2}$ being particularly preferred.

The silver halide emulsion layers of the present invention and also other photographic layers may incorporate couplers other than the pyrazolotriazole type magenta couplers of the present invention, such as non-diffusible couplers that react with the oxidation product of a color developing agent to form appropriately spreading diffusible dyes and polymer couplers. Reference may be made to the description in Japanese Patent Application No. 193611/1984 filed for the non-diffusible couplers that react with the oxidation product of a color developing agent to form appropriately spreading diffusible dyes, and to the description in Japanese Patent Application No. 172151/1984 by the same applicant for the polymer couplers.

The pyrazolotriazole type magenta couplers of the present invention and other couplers (e.g., DIR compounds) may be incorporated in the silver halide emulsions of the present invention, as well as in the coating solutions of other photographic layers, by various techniques. If the couplers are alkali-soluble, they may be added in the form of alkaline solutions. Oil-soluble couplers are preferably added to silver halide emulsions after they are dispersed in fine particles in high-boiling solvents, optionally in combination with low-boiling solvents, in accordance with the methods described in U.S. Pat. Nos. 2,322,027, 2,801,170, 2,801,171, 2,272,191 and 2,304,940. In this case, additives such as hydroquinone derivatives, ultraviolet absorbers and antifading agents may also be used together with these couplers. The couplers may be used either singly or in admixture. One method preferred for use in the invention for the purpose of adding couplers in hereunder described: one or more of the couplers are dissolved in high-boiling solvents and/or low-boiling solvents, optionally together with other couplers, hydroquinone derivatives, anti-fading agents or ultraviolet absorbers. Suitable high-boiling solvents are organic acid amides, carbamates, esters, ketones, urea derivatives, ethers and hydrocarbons. The resulting solution is then mixed with an aqueous solution containing an anionic surfactant and/or a nonionic surfactant and/or a hydrophilic binder. The mixture is agitated in a high-speed mixer, colloid mill or an ultrasonic disperser so as to make a dispersion of the couplers for incorporation in silver halide emulsions.

The couplers may also be dispersed by the latex dispersion method.

The silver halide color photographic material of the present invention may incorporate various other photographic additives, such as anti-color stain agents of the types described in Unexamined Published Japanese Patent Application No. 2128/1971 and U.S. Pat. No. 2,728,659; as well as anti-foggants, stabilizers, ultraviolet absorbers, anti-color stain agents, brighteners, anti-fading agents, antistats, hardeners, surfactants, plasticizers and wetting agents of the types described in Research Disclosure No. 17643. Various hydrophilic colloids may be used in preparing emulsions for incorporation in the silver halide color photographic material of the invention. Suitable examples are proteins such as gelatin, gelatin derivatives, gelatin to which other polymers are grafted, albumin and casein; cellulose derivatives such as hydroxyethyl cellulose and carboxymethyl cellulose; starch derivatives; and synthetic hydrophilic polymers such as homo- or copolymers of vinyl alcohol, vinylimidazole, acrylamide, etc.

A variety of transparent supports may be used with the silver halide color photographic material of the invention and they include glass plate, polyester films such as those of cellulose acetate, cellulose nitrate and polyethylene terephthalate, polyamide film, polycarbonate film and polystyrene film. A suitable support should be selected depending upon the specific object of the photographic material of the invention.

The silver halide emulsion layers and other photographic layers used in the present invention may be coated by a variety of techniques such as dip coating, air doctor coating, curtain coating and hopper coating. Two or more layers may be coated simultaneously by the method described in U.S. Pat. Nos. 2,761,791 and 2,941,898.

The photographic material using the silver halide emulsions of the present invention may be processed by any of the known methods. Typical processing methods are as follows:

(1) color development, followed by bleach-fixing and optionally by washing and/or stabilization; (2) color development, followed by separate steps of bleaching and fixing, and optionally by washing and/or stabilization; (3) processing consisting, in sequence, of prehardening, neutralization, color development, stop fixation, washing, bleaching, fixation, washing, post-hardening and washing; (4) processing comprising, in sequence, color development, washing, auxiliary color development, stopping, bleaching, fixation, washing and stabilization; and (5) color development followed by the halogenation bleaching of the resulting developed silver, which is subjected to another color development for the purpose of forming an increased amount of dye.

The color developer used in the processing of silver halide emulsions of the present invention is not critical for the purpose of the present invention, and is usually an aqueous alkaline solution that contains a color developing agent and has a pH of preferably at least 8, more preferably 9 to 12. An aromatic primary amino developing agent which is typically used as the color developing agent is a compound that has a primary amino group on the aromatic ring and which has the ability to develop exposed silver halide. If necessary, a precursor that forms such compound may also be used.

Typical color developing agents are p-phenylenediamine compounds and the following are preferred: 4-amino-N,N-diethylaniline, 3-methyl-4-amino-N,N-diethylaniline, 4-amino-N-ethyl-N-β-hydroxyethylaniline, 3-methyl-4-amino-N-β-hydroxyethylaniline, 3-methyl-4-amino-N-ethyl-N-β-methoxyethylaniline, 3-methyl-4-amino-N-methyl-N-β-methanesulfonamidoethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-dimethylaniline, N-ethyl-N-β-[β-(β-methoxyethoxy)ethoxy]-ethyl-3-methyl-4-aminoaniline, N-ethyl-N-β-(β-methoxyethoxy(-ethyl-3-methyl-4-aminoaniline; as well as salts thereof such as sulfates, hydrochlorides, sulfites and p-toluenesulfonates.

Other typical examples of the color developing agent are those described in Unexamined Published Japanese Patent Application Nos. 64932/1973, 131526/1975 and 95849/1976; and Bent et al., Journal of the American Chemical Society, 73, pp. 3100-3125, 1951.

The amount of these aromatic primary amino compounds used depends on the level at which the activity of the developing solution should be set, and in order to attain higher activities, greater amounts of aromatic primary amino compounds are preferably used. They are generally used in amounts ranging from 0.0002 mol/1,000 ml to 0.7 mol/1,000 ml. Two or more aromatic primary amino compounds may be used to attain specific objects Illustrative combinations are that of 3-methyl-4-amino-N,N-diethylaniline and 3-methyl-4-amino-N-ethyl-N-β-methanesulfonamidoethylaniline, and that of 3-methyl-4-amino-N-ethyl-N-β-methanesulfonamidoethylaniline and 3-methyl-4-amino-N-ethyl-N-β-hydroxyethylaniline.

The color developer used in the present invention may also contain a variety of conventional additives such as alkali agents (e.g., sodium hydroxide and sodium carbonate); alkali metal sulfites, alkali metal hydrogensuites, alkali metal thiocyanates, alkali metal halides, benzyl alcohol, water softeners, thickeners and development accelerators.

Other additives that may be incorporated in the developing solution are bromides such as potassium bromide and ammonium bromide; compounds for rapid processing such as alkali iodide, nitrobenzimidazole, mercaptobenzimidazole, 5-methyl-benzotriazole and 1-phenyl-5-mercaptotetrazole; anti-stain agents, anti-sludge agents, preservatives, interimage effect accelerating agents, and chelating agents.

Bleaching agents are used in bleaching baths or bleachfixing baths and generally known bleaching agents are aminopolycarboxylic acids or organic acids such as oxalic acid and citric acid, which are coordinated to metal ions such as iron, cobalt and copper. Typical aminopolycarboxylic acids are listed below:

ethylenediaminetetraacetic acid;
diethylenetriaminepentaacetic acid;
propylenediaminetetraacetic acid;
nitrilotriacetic acid;
iminodiacetic acid;
ethyletherdiaminetetraacetic acid;
ethylenediaminetetrapropionic acid;
ethylenediaminetetraacetic acid disodium salt;
diethylenetriaminepentaacetic acid pentasodium salt;
and nitrilotriacetic acid sodium salt.

In addition to the bleaching agents listed above, a variety of additives may be incorporated in the bleaching bath. The bleaching step may be performed with a bleach-fixing bath containing a silver halide fixing agent in addition to any of the bleaching agents mentioned above. The bleach-fixing bath may also contain a halogen compound such as potassium bromide. As in the case of the bleaching bath, the bleach-fixing bath may contain a variety of additives such as pH buffer, antifoaming agent, surfactant, preservative, chelating agent, stabilizing agent and an organic solvent.

Suitable silver halide fixing agents may be sodium thiosulfate, ammonium thiosulfate, potassium thiocyanate, sodium thiocyanate, thiourea, thioether and any other compound that is conventionally used in the fixing step so as to form water-soluble silver salts by reaction with silver halides.

In order to ensure rapid processing, the color development of the silver halide color photographic material of the invention and bleach-fixing thereof (or bleaching and fixing in separate steps), as well as optional steps of. washing, stabilization and drying are preferably carried out at temperatures not lower than 30° C.

The silver halide color photographic material of the present invention may be processed by washing replacing stabilization techniques as taught in Unexamined Published Japanese Patent Application Nos. 14834/1983, 105145/1983, 134634/1983 and 18631/1983; and Japanese Patent Application Nos. 2709/1983 and 89288/1984.

EXAMPLES

The present invention is hereunder described in greater detail with reference to the following specific examples, to which however the possible embodiments of the invention are by no means limited. In the following examples, the amounts of ingredients in a silver halide photographic material are expressed in terms of the value per square meter, unless otherwise noted. The amounts of silver halide and colloidal silver are indicated in terms of silver.

The following explanation starts with the description of the emulsions for use in a green-sensitive layer in the light-sensitive material prepared in accordance with the present invention; the explanation then proceeds to comparative emulsions and ends with the description of the results obtained by using the respective samples of photographic light-sensitive material.

The emulsions intended for use in a green-sensitive layer in the light-sensitive material of the present invention were prepared by the following procedures.

Using the seven solutions A-1 to G-1 (for their compositions, see below), core/shell type silver iodobromide emulsions, EM-1 and EM-2, having a silver iodide content profile of 15 mol%, 5 mol% and 0.3 mol% from the center outward were prepared. The seed emulsion was a monodispersed silver iodobromide emulsion having a silver iodide content of 2.6 mol% which contained grains with an average size of 0.8 μm and a coefficient of variation of 11% in the grain-size distribution. The "coefficient of variation" is a parameter indicating the degree of dispersibility of grains and may be defined as follows:

$$\text{Coefficient of variation} = \frac{\text{standard deviation of grain sizes}}{\text{average grain size}} \times 100(\%).$$

Two octahedral emulsions, EM-5 and EM-6, comprising silver iodobromide grains (with 4 mol% silver iodide) with an average size of 1.6 μm were prepared in accordance with the description in Unexamined Published Japanese Patent Application No. 14829/1983. The emulsion EM-5 comprised core/shell type silver iodobromide grains having a silver iodobromide (AgI: 0.3 mol%) shell coat with a thickness of 0.2 μm; EM-6 contained silver iodobromide grains having a uniform distribution of silver iodide in the absence of a silver bromide shell.

A twinned emulsion EM-7 comprising silver iodobromide grains (4 mol% silver iodide) having an average size of 1.6 μm was prepared in accordance with the description in Japanese Patent Publication No. 1417/1976.

Emulsions EM-1' to EM-7' were prepared; they were the same as EM-1, EM-2, EM-5, EM-6, EM-7, EM-3 and EM-4 (the last two will be described hereinafter), respectively, in terms of the composition and crystal habit of silver halide grains except that the emulsion grains in EM-1' to EM-7' had an average size of 0.8 μm. In the samples of photographic material which were subsequently prepared (see below), the emulsions EM-1 to EM-7 having an average grain size of 1.6 μm were incorporated in highly green-sensitive layers (GH) while the emulsions EM-1' to EM-7' having an average grain size of 0.8 μm were incorporated in less green-sensitive layers (GL).

Using the emulsions thus prepared, samples of light-sensitive material were subsequently made in accordance with the present invention, and comparative samples were also made.

| | |
|---|---|
| Solution A-1 | |
| Ossein gelatin | 22.5 g |
| Distilled water | 6799 ml |
| Sodium salt of polyisopropylene/polyethyleneoxydisuccinate ester (10% aq. sol. in ethanol) | 20 ml |
| 4-Hydroxy-6-methyl-1,3,3a-7-tetrazaindene | (See TABLE 1) |
| 28% Aqueous ammonia | 469 ml |
| Seed emulsion | equivalent to 0.8828 mole |
| Solution B-1 | |
| Ossein gelatin | 6.0 g |
| KBr | 212 g |
| KI | 52.3 g |
| 4-Hydroxy-6-methyl-1,3,3a-7-tetrazaindene | (See TABLE 1) |
| Distilled water | 50 ml |
| Solution C-1 | |
| Ossein gelatin | 5.0 g |
| KBr | 198 g |
| KI | 14.5 g |
| 4-Hydroxy-6-methyl-1,3,3a-7-tetrazaindene | (See TABLE 1) |
| Distilled water | 422 ml |
| Solution D-1 | |
| Ossein gelatin | 20 g |
| KBr | 830 g |
| KI | 3.5 g |
| 4-Hydroxy-6-methyl-1,3,3a-7-tetrazaindene | (See TABLE 1) |
| Distilled water | 1672 ml |
| Solution E-1 | |
| $AgNO_3$ | 1109 g |
| 28% Aqueous ammonia | 904 ml |
| Distilled water to make | 1866 ml |
| Solution F-1 | |
| KBr (50% aq. sol.) | sufficient amount for pAg adjustment |
| Solution G-1 | |
| Acetic acid (56% aq. sol.) | sufficient amount for pH adjustment |

At 50° C., solutions E-1 and B-1 were added simultaneously to solution A-1 by the double-jet method with a mixer/agitator of the type shown in Unexamined Published Japanese Patent Application Nos. 92523/1982 and 92524/1982. Solution G-1 was added simultaneously with completion of the addition of B-1, and D-1 was added simultaneously with completion of the addition of C-1. During the addition of solutions E-1 and B-1 by the double-jet method, the pAg and pH of the mixture were controlled by supplying varying amounts of solutions F-1 and G-1 with a variable flow rate roller tube pump.

Two minutes after completion of the addition of solution E-1, the pAg of the mixture was adjusted to 10.4 by addition of F-1, and 2 more minutes later, the pH was adjusted to 6.0 by addition of G-1.

TABLE 1

| | Amounts of Tetrazaindene Added | | | |
|---|---|---|---|---|
| Emulsion | Solution A-1 | Solution B-1 | Solution C-1 | Solution D-1 |
| EM-1 | 277 mg | 42 mg | 35 mg | 139 mg |

TABLE 1-continued

| | Amounts of Tetrazaindene Added | | | |
|---|---|---|---|---|
| Emulsion | Solution A-1 | Solution B-1 | Solution C-1 | Solution D-1 |
| EM-2 | 415 mg | 63 mg | 52 mg | 209 mg |

A comparative silver iodobromide emulsion, EM-3, comprising non-core/shell type grains with a silver iodide content of 7 mol% was prepared using the five solutions, A-2, B-2, E-2, F-2 and G-2, having the compositions indicated below.

Emulsion EM-4 was prepared in accordance with the present invention using the same five solutions. Each of EM-3 and EM-4 was prepared from a monodispersed seed silver iodobromide emulsion having a silver iodide content of 3.7 mol%; the nuclear grains in each emulsion had an average size of 0.8 μm and a coefficient of variation of 12% in the grain-size distribution.

| | |
|---|---|
| Solution A-2 | |
| Ossein gelatin | 22.5 g |
| Distilled water | 6799 ml |
| Sodium salt of polyisopropylene/polyethyleneoxydisuccinate ester (10% aq. sol. in ethanol) | 20 ml |
| 4-Hydroxy-6-methyl-1,3,3a-7-tetrazaindene | (See TABLE 2) |
| 28% Aqueous ammonia | 469 ml |
| Seed emulsion | equivalent to 0.8828 mole |
| Solution B-2 | |
| Ossein gelatin | 24.0 g |
| KBr | 962 g |
| KI | 51.6 g |
| 4-Hydroxy-6-methyl-1,3,3a-7-tetrazaindene | (See TABLE 2) |
| Distilled water | 2024 ml |

TABLE 2

| | Amounts of Tetrazaindene Added | |
|---|---|---|
| Emulsion | Solution A-2 | Solution B-2 |
| EM-3 | 0 mg | 0 mg |
| EM-4 | 415 mg | 252 mg |

| | |
|---|---|
| Solution E-2 | |
| $AgNO_3$ | 1109 g |
| 28% Aqueous ammonia | 904 ml |
| Distilled water to make | 1866 ml |
| Solution F-2 | |
| KBr (50% aq. sol.) | sufficient amount for pAg adjustment |
| Solution G-2 | |
| Aetic acid (56% aq. sol.) | sufficient amount for pH adjustment |

AT 50° C., solutions E-2 and B-2 were added to solution A-2 by the double-jet method with a mixer/agitator of the same type as used before. During the addition of E-2 and B-2 by the double-jet method, the pAg and pH of the mixture were controlled by supplying varying amounts of solutions F-2 and G-2 with a variable flow rate roller tube pump. Two minutes after completion of the addition of solution E-2, the pAg of the mixture was adjusted to 10.4 by addition of F-2, and two minutes later the pH was adjusted to 6.0 by addition of G-2.

The mixture was desalted and washed by routine methods After dispersing the washed mixture in an aqueous solution containing 127 g of ossein gelatin, distilled water was added to make a total volume of 3,000 ml. The emulsion grains in each of EM-1, EM-2, EM-3 and EM-4 had an average size of 1.6 μm and a coefficient of variation of 11% in the grain-size distribution. Details of the core/shell structure possessed by the silver halide grains in each of the four emulsions are shown in Table 3.

TABLE 3

| | Core/Shell Structure | | | | | | | | | |
|---|---|---|---|---|---|---|---|---|---|---|
| | Core | | Shell (A) | | Shell (B) | | Shell (C) | | Average | |
| Emulsion | Av. grain size (μm) | Composition | Thickness (μm) | Composition | Thickness (μm) | Composition | Thickness (μm) | Composition | grain size (μm) | Crystal habit |
| EM-1 (sample of the invention) | 0.8 | AgIBr (AgI: 2.6 mol %) | 0.16 | AgIBr (AgI: 15 mol %) | 0.04 | AgIBr (AgI: 5 mol %) | 0.20 | AgIBr (AgI: 0.3 mol %) | 1.6 | semi(110)*1 |
| EM-2 (sample of the invention) | 0.8 | AgIBr (AgI: 2.6 mol %) | 0.16 | AgIBr (AgI: 15 mol %) | 0.04 | AgIBr (AgI: 5 mol %) | 0.20 | AgIBr (AgI: 0.3 mol %) | 1.6 | semi(110)*2 |
| EM-3 (comparative sample) | | | AgIBr (uniform composition, with 3.7 mol % I) | | | | | | 1.6 | (100)*3 |
| EM-4 (sample of the invention) | | | | | | | | | 1.6 | semi(110) |

(Notes)
[1]Each particle consisted of the core, shell (A), shell (B) and shell (C) from the center outward.
[2]*1 denotes that the outer surfaces of the particle were principally composed of (100) and (110) faces.
[3]*2 and *3 denote that the outer surfaces of the particles were principally composed of (110) and (100) faces, respectively.

EXAMPLE 1

Samples of photographic light-sensitive material were prepared, with the emulsions of the present invention and the comparative emulsions being incorporated in a GL layer (less green-sensitive layer) and a GH layer (highly green-sensitive layer).

The transparent bases for the samples were each composed of a subbed cellulose triacetate film having an anti-halation layer (containing 0.40 g of black colloidal silver and 3.0 g of gelatin). These bases were coated with the following layers in the order written.

Layer 1: Less red-sensitive silver halide emulsion layer (RH-1)

This layer contained 1.8 g of a red-sensitized emulsion (EM-1) composed of AgBrI (with 7 mol% AgI) and a dispersion which was prepared by emulsifying a solution in tricresyl phosphate (0.65 g, TCP) of the following ingredients in an aqueous solution containing 1.85 g of gelatin: 0.8 g of 1-hydroxy-4-(β -methoxyethylaminocarbonylmethoxy)-N-[δ-(2,4-di-t-amylphenoxy)butyl]-2-naphthoamide (C-1), 0.075 g of 1-hydroxy-4-[4-(1-hydroxy-8-acetamido-3,6-disulfo-2-naphthylazo)phenoxy]-N-[δ-(2, 4-di-t-amylphenoxy)-butyl]-2-naphthoamide disodium (CC-1), 0.015 g of 1-hydroxy-2-[δ-(2,4-di-t-aminophenoxy)-n-butyl]naphthoamide, and 0.07 g of 4-octadecylsuccinimido-2-(1-phenyl-5-tetrazolylthio)-1-indanone (D-1).

Layer 2: Highly red-sensitive silver halide emulsion layer (RH-1)

This layer contained 1.2 g of a red-sensitized emulsion (EM-2) composed of AgBrI (with 6 mol% AgI) and a dispersion which was prepared by emulsifying a solution in TCP (0.23 g) of the following ingredients in an aqueous solution containing 1.2 g of gelatin: 0.21 g of a cyan coupler (C-1) and 0.02 g of a colored cyan coupler (CC-1).

Layer 3: Intermediate layer (IL)

This layer contained 0.8 g of gelatin and 0.04 g of dibutyl phthalate (DBP) having 0.07 g of 2,5-di-t-octylhydroquinone (HQ-1) dissolved therein.

Layer 4: Less green-sensitive silver halide emulsion layer (GL-1)

This layer contained combinations (see Table 4-1 below) of 0.80 g of each of the green-sensitized, EM-1' to EM-7', and 0.80 g of a selected compound used as the magenta coupler of the present invention. This layer 4 contained a selected emulsion and a dispersion which was prepared by emulsifying 0.95 g of dinonyl phenol in an aqueous solution containing 2.2 g of gelatin, with the dinonyl phenol having a selected compound and 0.01 g of a DIR compound (D-1) dissolved therein.

Layer 5: Highly green-sensitive silver halide emulsion layer (GH-1)

This layer contained combinations (see Table 4-1) of 1.8 g of each of the green-sensitized emulsions, EM-1 to EM-7, and 0.20 g of a selected compound used as the magenta coupler of the present invention. This layer 5 contained a selected emulsion and a dispersion which was prepared by emulsifying 0.25 g of dinonyl phenol in an aqueous solution containing 1.9g of gelatin, with the dinonyl phenol having a selected compound dissolved therein.

Layer 6: Yellow filter layer (YF)

This layer contained 0.15 g of yellow colloidal silver, 0.11 g of DBP having 0.2 g of an anti-stain agent (HQ-1) dissolved therein, and 1.5 g of gelatin.

Layer 7: Less blue-sensitive silver halide emulsion layer (BL-1)

This layer contained 0.2 g of the blue-sensitized EM-1 and a dispersion which was prepared by emulsifying a solution in TCP (0.6 g) of the following ingredients in an aqueous solution containing 1.9 g of gelatin: 1.5 g of α-pivaloyl-α-(1-benzyl -2-phenyl-3,5-dioxoimidazolidin-4-yl)-2-chloro-5-[α-dodecyloxycarbonyl)ethoxycarbonyl]acetanilide (Y-1).

Layer 8: Highly blue-sensitive silver halide emulsion layer (BH-1)

This layer contained 0.9 g of a blue-sensitized emulsion composed of AgBrI (with 2 mol% AgI) and a dispersion which was prepared by emulsifying a solution in TCP (0.65 g) of the following ingredient in an aqueous solution containing 1.5 g of gelatin: 1.30 g of a yellow coupler (Y-1).

Layer 9: Protective layer (Pro)

This was a gelatin layer containing 0.23 g of gelatin, poly(methyl methacrylate) particles (2.5 μm in diameter) and a dispersion of the following ultraviolet absorbers, UV-1 and UV-2:

UV-1: 2-(2-benzotriazolyl)-4-t-pentylphenol;

UV-2: 2-(3-cyano-3-(n-dodecylaminocarbonyl)anilidene-1-ethylpyrrolidine.

The gelatin solution in Layer 9 was prepared by preliminary treatment (pH, 6.5; 63° C.; 60 min) of a 10% aqueous solution of medium-viscosity gelatin with a gelatin hardener (H-1) to be described hereinafter.

Each of the layers 1 to 9 also contained a gelatin hardener (H-2, to be described hereinafter) and a surfactant.

The samples of photographic material thus prepared using the emulsions and magenta coupler compounds listed in Table 4-1 were exposed under white light through an optical wedge and subsequently developed by either one of the procedures 1 to 3, which were identical with each other except that the pH of the color developer was varied as follows:

Procedure 1: pH, 9.5

Procedure 2: pH, 10.02

Procedure 3: pH, 10.52.

The scheme used to process the samples was as follows.

| | | |
|---|---|---|
| Color development | 38° C. | 3 min and 15 sec |
| Bleaching | 38° C. | 6 min and 30 sec |
| Washing | 38° C. | 3 min and 15 sec |
| Fixing | 38° C. | 6 min and 30 sec |
| Washing | 38° C. | 3 min and 15 sec |
| Stabilizing | 38° C. | 1 min and 30 sec |
| Drying | | |

The working solutions had the following compositions.

| | |
|---|---|
| Color developer: | |
| 4-Amino-3-methyl-N-ethyl-N-(β-hydroxyethyl)-aniline sulfate | 4.75 g |
| Anhydrous sodium sulfite | 4.25 g |
| Hydroxylamine hemisulfate | 2.0 g |
| Anhydrous potassium carbonate | 37.5 g |
| Sodium bromide | 1.3 g |
| Nitrilotriacetic acid trisodium salt (monohydrate) | 2.5 g |
| Potassium hydroxide | 1.0 g |
| Water to make | 1,000 ml |
| Bleaching bath: | |
| Ethylenediaminetetraacetic acid iron ammonium salt | 100.0 g |
| Ethylenediaminetetraacetic acid diammonium salt | 10.0 g |
| Ammonium bromide | 150.0 g |

-continued

| | |
|---|---|
| Glacial acetic acid | 10.0 ml |
| Water to make | 1,000 ml |
| pH adjusted to 6.0 with aqueous ammonia. | |
| Fixing bath: | |
| Ammonium thiosulfate | 175.0 g |
| Anhydrous sodium sulfite | 8.5 g |
| Sodium metasulfite | 2.3 g |
| Water to make | 1,000 ml |
| pH adjusted to 6.0 with acetic acid. | |
| Stabilizing bath: | |
| Formalin (37% aq. sol.) | 1.5 ml |
| Konidax (product of Konishiroku Photo Industry) | 7.5 ml |
| Water to make | 1,000 ml |

The emulsions and magenta couplers incorporated in the layers, GL and GH, in each of the samples are listed in Table 4-1. The fog, sensitivity and gamma data for the samples which were developed by one of the procedures 1 to 3 are given in Table 4-2.

TABLE 4-1

| Sample No. | Emulsion No. GL layer | Emulsion No. GH layer | Magenta coupler compound No | Remarks |
|---|---|---|---|---|
| 1 | EM-3' | EM-3 | 5 | com- |
| 2 | EM-5' | EM-5 | 5 | para- |
| 3 | EM-6' | EM-6 | 5 | tive |
| 4 | EM-7' | EM-7 | 5 | samples |
| 5 | EM-4' | EM-4 | 5 | samples |
| 6 | EM-1' | EM-1 | 5 | of the |
| 7 | EM-2' | EM-2 | 2 | invention |
| 8 | EM-2' | EM-2 | 4 | |
| 9 | EM-2' | EM-2 | 13 | |

TABLE 4-2

| | Development | | | | | | | | | |
|---|---|---|---|---|---|---|---|---|---|---|
| | Procedure - 1 (pH 9.50) | | | Procedure - 2 (pH 10.02) | | | Procedure - 3 (pH 10.52) | | | |
| | Factor | | | | | | | | | |
| Sample No. | Fog | Sensitivity | Gamma | Fog | Sensitivity | Gamma | Fog | Sensitivity | Gamma | Remarks |
| Sample 1 | 0.19 | 82 | 0.42 | 0.23 | 100 | 0.65 | 0.36 | 105 | 0.59 | Com- |
| 2 | 0.18 | 81 | 0.43 | 0.21 | 101 | 0.63 | 0.35 | 104 | 0.58 | para- |
| 3 | 0.17 | 83 | 0.42 | 0.22 | 102 | 0.65 | 0.36 | 103 | 0.58 | tive |
| 4 | 0.18 | 80 | 0.41 | 0.21 | 101 | 0.64 | 0.35 | 103 | 0.59 | samples |
| 5 | 0.18 | 126 | 0.61 | 0.18 | 127 | 0.63 | 0.20 | 130 | 0.65 | Samples |
| 6 | 0.17 | 126 | 0.62 | 0.17 | 126 | 0.65 | 0.20 | 130 | 0.66 | of the |
| 7 | 0.18 | 128 | 0.61 | 0.18 | 130 | 0.65 | 0.21 | 135 | 0.67 | invention |
| 8 | 0.16 | 125 | 0.62 | 0.17 | 127 | 0.64 | 0.20 | 131 | 0.64 | |
| 9 | 0.18 | 123 | 0.61 | 0.19 | 125 | 0.65 | 0.22 | 130 | 0.65 | |

As the data in Table 4-2 show, the samples of photographic material prepared in accordance with the present invention were highly stabilized against variations in the pH of the developing solution; no abnormal phenomenon occurred in these samples even when they were developed at varying pHs and, in addition, they experienced minimum changes in sensitivity and gamma values. It is therefore clear that the present invention provides a photographic light-sensitive material which is stable against variations in the conditions of development.

EXAMPLE 2

Sample Nos. 2-1 to 2-9 having the following layer arrangement were prepared as in Example 1.

Layer 1: same as RL-1 in Example 1;

Layer 2: same as IL in Example 1;

Layer 3: same as GL-1 in Example 1;

Layer 4: same as IL in Example 1;

Layer 5: same as BL-1 in Example 1;

Layer 6: same as IL in Example 1;

Layer 7: same as RH-1 in Example 1;

Layer 8: an intermediate layer containing 0.80 g of gelatin, 0.04 g of DBP having 0.07 g of HQ-1 dissolved therein, and 0.25 g of TCP having 0.03 g of a colored magenta coupler (CM-1) dissolved therein;

Layer 9: same as GH-1 in Example 1;

Layer 10: intermediate layer containing 0.80 g of gelatin, 0.04 g of DBP having 0.07 g of HQ-1 dissolved therein, and a AgBrI emulsion (20 mol% AgI) comprising grains with an average size of 0.08 μm;

Layer 11: same as BH-1 in Example 1; and

Layer 12: same as Pro in Example 1.

The emulsions and magenta couplers incorporated in Layers 3 and 8 in Sample Nos. 2-1 to 2-9 were the same as those used in Sample Nos. 1 to 9 prepared in Example 1.

The so prepared samples were subjected to color development by one of the following procedures 4 to 6 which were the same as procedure 2 employed in Example 1 (pH, 10.02) except that the concentration of the color developing agent, 4-amino-3-methyl-N-(β-hydroxyethyl)aniline sulfate, was varied as shown below. The resulting color images were evaluated for their sensitometric properties and graininess. The other conditions of color development were the same as in Example 1.

Procedure 4: 2.5 g

Procedure 5: 4.75 g

Procedure 6: 9.5 g

The results of the evaluations are summarized in Table 5.

Sample Nos. 2-1 to 2-9 were exposed under white light through an optical wedge under the same conditions and subsequently processed photographically. The data for variations in the gamma of the green-sensitive layers in the color image formed in each sample are also shown in Table 5.

H-1

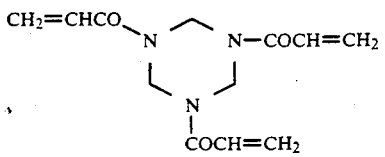

H-2:

$[(CH_2{=}CHSO_2CH_2)_3CCH_2SO_2CH_2]_2N13$
$CH_2CH_2SO_3K$

CM-1: 1-(2,4,6-trichlorophenyl)-4-(1-naphthylazo)-3-(2-chloro-5-octadecenylsuccinimidoanilino) -5-pyrazolone.

TABLE 5

| | Development | | | | | | | | | | | | |
|---|---|---|---|---|---|---|---|---|---|---|---|---|---|
| | Procedure - 4 | | | | Procedure - 5 | | | | Procedure - 6 | | | | |
| | Factor | | | | | | | | | | | | |
| Sample | Fog | Sensitivity | Gamma | Graininess (RMS) | Fog | Sensitivity | Gamma | Graininess (RMS) | Fog | Sensitivity | Gamma | Graininess (RMS) | Remarks |
| 1 | 0.20 | 78 | 0.44 | 50 | 0.25 | 100 | 0.67 | 52 | 0.44 | 103 | 0.57 | 68 | Comparative samples |
| 2 | 0.22 | 79 | 0.45 | 48 | 0.24 | 102 | 0.66 | 51 | 0.45 | 105 | 0.55 | 67 | |
| 3 | 0.21 | 78 | 0.42 | 48 | 0.24 | 101 | 0.65 | 53 | 0.44 | 105 | 0.54 | 69 | |
| 4 | 0.20 | 76 | 0.43 | 50 | 0.23 | 101 | 0.66 | 50 | 0.47 | 104 | 0.55 | 68 | |
| 5 | 0.18 | 127 | 0.63 | 45 | 0.18 | 130 | 0.65 | 46 | 0.19 | 135 | 0.65 | 49 | Samples of the invention |
| 6 | 0.17 | 127 | 0.62 | 43 | 0.18 | 128 | 0.64 | 45 | 0.20 | 135 | 0.65 | 49 | |
| 7 | 0.19 | 128 | 0.61 | 43 | 0.19 | 133 | 0.66 | 46 | 0.19 | 137 | 0.65 | 48 | |
| 8 | 0.18 | 127 | 0.61 | 43 | 0.18 | 130 | 0.65 | 45 | 0.19 | 135 | 0.67 | 48 | |
| 9 | 0.19 | 125 | 0.62 | 44 | 0.20 | 127 | 0.64 | 45 | 0.21 | 135 | 0.66 | 49 | |

As is clear from Table 5, the present invention is capable of providing a photographic light-sensitive material that produces a high-quality image without experiencing deteriorated sensitometric properties or increased graininess even if variations occur in the developing solution employed.

ADVANTAGES OF THE INVENTION

In accordance with the present invention, a photographic light-sensitive material is provided that is stabilized against variations in the conditions of development and is capable of producing a high-quality image with a minimum increase in graininess and which yet retains the inherent advantages of the 1H-pyrazolo-[3,2-C]-S-triazole type magenta coupler, such as the absence of color contamination and high stability to noxious gases such as those emitted from formalin.

What is claimed is:

1. A silver halide photographic material having one or more silver halide emulsion layers on a support, the emulsion in at least one of said silver halide emulsion layers containing at least one magenta coupler represented by the following formula (I), said emulsion containing silver halide grains which have a semi (110) grain structure, the silver halide composition of said grains being substantially made of silver bromide and/or silver iodobromide:

(I)

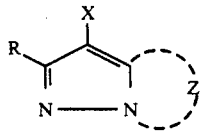

where Z represents a group of the non-metallic atoms necessary for forming a nitrogen-containing hetero ring which may have a substituent; X is a hydrogen atom or a substituent which is capable of being eliminated upon reaction with the oxidation product of a color developing agent; and R is a hydrogen atom or a substituent.

2. A silver halide photographic material according to claim 1, wherein the emulsion in at least one of said silver halide emulsion layers contains said magenta coupler in an amount of $1\times10^{-3}$ to 1 mole per mole of silver halide.

3. A silver halide photographic material according to claim 1, wherein the emulsion in at least one of said silver halide emulsion layers contains a magenta coupler represented by said formula (I) and a pyrazolone based magenta coupler.

4. A silver halide photographic material according to claim 1, wherein said magenta coupler is represented by the following formula (VI):

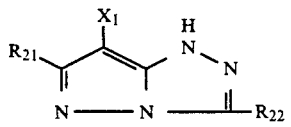

(VI)

wherein $R_{21}$ is a group represented by the formula $R_{29}$—$CH_2$— (where $R_{29}$ is a hydrogen atom or an alkyl group which may have a substituent); $R_{22}$ is a halogen atom, an alkyl group, an alkenyl group, a cycloalkenyl group, an alkinyl group, an aryl group, a heterocyclic group, an acyl group, a sulfonyl group, a sulfinyl group, a phosphonyl group, a carbamoyl group, a sulfamoyl group, a cyano group, a spiro-compound residue, a bridged hydrocarbon compound residue, an alkoxy group, an aryloxy group, a heterocyclic oxy group, a siloxy group, an acyloxy group, a carbamoyloxy group, an amino group, an acylamino group, a sulfonamide group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group or a heterocyclic thio group, each of which groups may have a substituent; and X is a hydrogen atom or a group capable of leaving upon reaction with the oxidized product of a color developing agent.

5. A silver halide photographic material according to claim 2, wherein the core of said silver halide grains having a core/shell structure has a silver halide composition containing 3 to 40 mol% of silver iodide and the shell has a silver halide composition containing 0 to 10 mol% of silver iodide.

6. A silver halide photographic material according to claim 6, wherein the shell of said silver halide grains having a core/shell structure has a thickness of 0.01 to 0.3 μm.

7. A silver halide photograhic material according to claim 1, wherein said silver halide grains are those obtained in the presence of at least one compound selected from the group consisting of compounds represented by the following formulas (IT), (IIT),(IIIT) and (IVT) and compounds having a recurring unit represented by the following formula (VT):

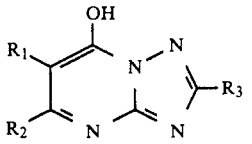

(IT)

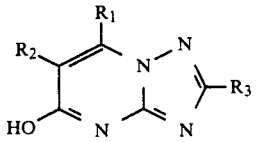

(IIT)

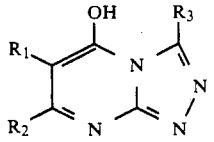

(IIIT)

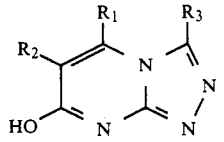

(IVT)

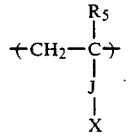

(VT)

wherein $R_1$, $R_2$ and $R_3$ which may be the same or different each represents a hydrogen atom, a halogen atom, an amino group, an amino group derivative, an alkyl group, an alkyl group derivative, an aryl group, an aryl group derivative, a cycloalkyl group, a cycloalkyl group derivative, a mercapto group derivative, or —CONH—$R_4$ (where $R_4$ is a hydrogen atom, an alkyl group, an amino group, an alkyl group derivative, an amino group derivative, a halogen atom, a cycloalkyl group, a cycloalkyl group derivative, an aryl group or an aryl group derivative); $R_5$ represents a hydrogen atom or an alkyl group; $R_1$ and $R_2$ may cooperate to form a ring; X represents a monovalent group obtained by eliminating one hydrogen atom from the compound of formula (IT), (IIT), (IIIT) or (IVT); and J represents a divalent linkage.

8. A silver halide photographic material according to claim 1, wherein said silver halide grains are monodispersed silver halide grains.

9. A silver halide photographic material according to claim 8, wherein said monodispersed silver halide grains have such a size distribution that the value of $S/\bar{r}$, where S is the standard deviation of the size distribution and $\bar{r}$ is the arithmetic mean of sizes, is 0.20 or below.

10. A silver halide photographic material according to claim 9, wherein said monodispersed silver halide grains have such a size distribution that the value of $S/\bar{r}$ is 0.15 or below.

* * * * *